United States Patent [19]

Hanft et al.

[11] 4,374,625

[45] Feb. 22, 1983

[54] TEXT RECORDER WITH AUTOMATIC WORD ENDING

[75] Inventors: Roy F. Hanft; Gerald G. Pechanek, both of Lexington, Ky.

[73] Assignee: IBM Corporation, Armonk, N.Y.

[21] Appl. No.: 145,523

[22] Filed: May 1, 1980

[51] Int. Cl.[3] ..... B41J 3/02

[52] U.S. Cl. ..... 400/98; 340/146.3 WD; 364/900; 400/70; 400/83

[58] Field of Search ..... 400/70, 83, 84, 85, 400/87, 91, 92, 93, 94, 95, 98, 99, 109, 110, 482, 484; 364/200, 900; 228/263 J; 219/10.43; 340/146.3 WD

[56] References Cited

U.S. PATENT DOCUMENTS

| | | | |
|---|---|---|---|
| 1,275,657 | 8/1918 | Bullock | 400/98 |
| 2,717,686 | 9/1955 | Seeber, Jr. | 400/70 X |
| 3,005,254 | 10/1961 | Thomas | 228/263 J X |
| 3,024,761 | 3/1962 | Bertelsen | 219/10.43 X |
| 3,188,609 | 6/1965 | Harmon et al. | 340/146.3 WD |
| 3,289,804 | 12/1966 | Schaefer | 400/98 |
| 3,820,644 | 6/1974 | Yeh | 400/110 |
| 3,925,761 | 12/1975 | Chaires et al. | 340/146.3 WD |
| 3,995,254 | 11/1976 | Rosenbaum | 340/146.3 WD |

FOREIGN PATENT DOCUMENTS

| | | | |
|---|---|---|---|
| 1439274 | 6/1976 | United Kingdom | 400/110 |

OTHER PUBLICATIONS

IBM Technical Disclosure Bulletin, "Abbrevated Typing for Word Processing", Todd, vol. 21, No. 9, Feb. 1979, pp. 3796–3797.

IBM Technical Disclosure Bulletin, "Word Generation System for Typist", Arellano et al., vol. 17, No. 8, Jan. 1975, pp. 2422–2423.

*Primary Examiner*—Ernest T. Wright, Jr.

*Attorney, Agent, or Firm*—Pollock, Vande Sande & Priddy

[57] ABSTRACT

A text recorder of the type which includes a text display device to record text in intelligible form on a typewritten page or line or page-like display in response to character and function identifying signals, a keyboard with a plurality of alphabetic, numeric, symbol and function keys for actuation by an operator to produce a keyboard signal unique to the actuated key, decoding means responsive to keyboard signals from said keyboard to produce character and function identifying signals and wherein the decoding means includes a word completion means for producing one of at least two groups of one or more character identifying signals in response to actuation of a selectd key on said keyboard, each group of character identifying signals representing a different word ending and wherein the word completion means includes means for selecting among the group dependent upon the identity of one or more keys actuated prior to actuation of the selected key.

28 Claims, 28 Drawing Figures

FIG I

FIG 4C
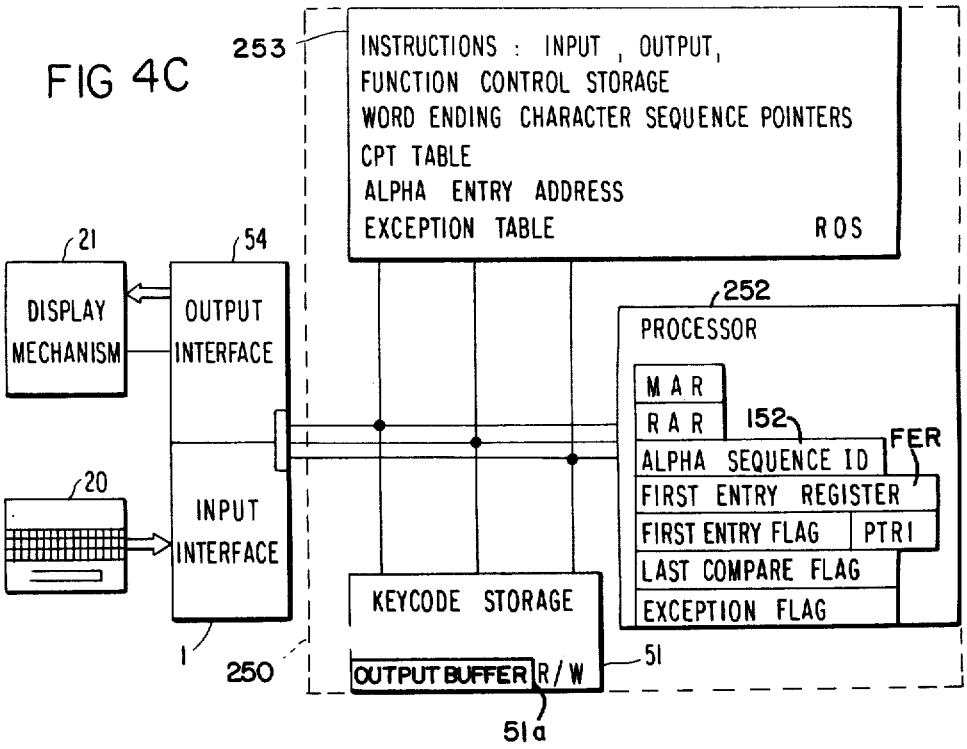
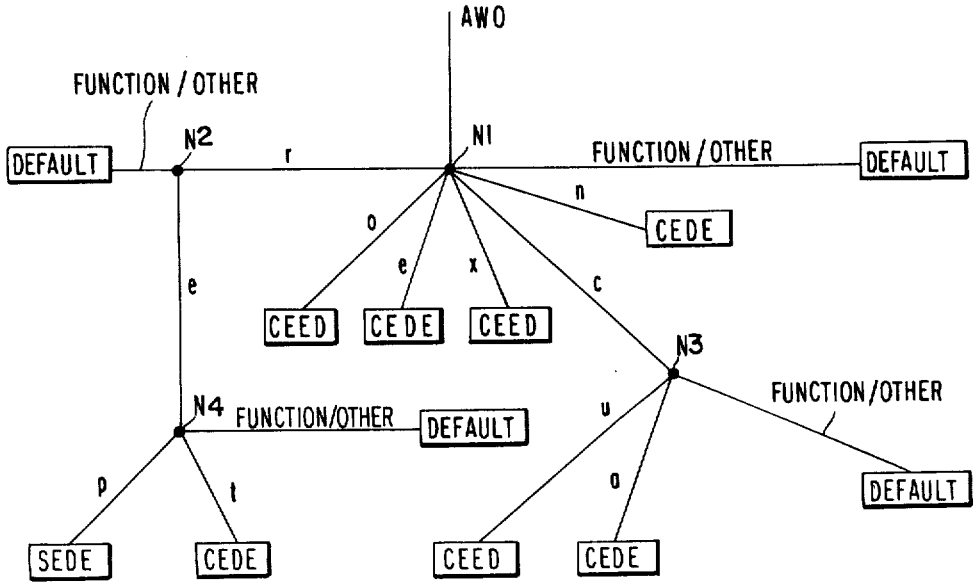
FIG 5 CEED , SEDE , CEDE DECISION TREE

ALPHABETIC CHARACTER PRECEDING WORD ENDING

| WORD ENDING | A | C | D | E | G | H | I | L | M | N | O | P | R | S | T | U | V | W | X |
|---|---|---|---|---|---|---|---|---|---|---|---|---|---|---|---|---|---|---|---|
| SEDE | | | | | | | | | | | | | 1 | | | | | | |
| CEED | | 1 | | | | | | | | | 1 | | | | | | | | 1 |
| CEDE | | 1 | | 4 | | | | | | 1 | | | 1 | | | | | | |
| YZE | | | | | | | | 2 | | | | | | | | | | | |
| ISE | | 5 | 2 | | | 5 | | | 4 | | | 1 | 7 | | 3 | 1 | 7 | 7 | |
| IZE | | 4 | 3 | | 3 | 2 | | 47 | 6 | 19 | | | 21 | 3 | 13 | | | | |
| SION | 4 | | | 1 | | | 11 | | | | 1 | | 4 | 23 | | 7 | | | |
| TION | 156 | 25 | | 1 | | | 15 | | | 6 | 2 | 5 | 2 | 2 | | 9 | | | |

FREQUENCY OF OCCURRENCE

FIG 11

NOTE : 1, THE ALPHABETIC CHARACTERS "B-F-J-K-Q-Y-Z" DO NOT PRECEDE ANY ALLOWED WORD ENDING
2, THE ALPHABETIC CHARACTERS "G-V-W-X" PRECEDE ONLY ONE WORD ENDING

FIG 12

CHARACTER PRECEDING TABLE (CPT)

| NUMERIC CODE ADDRESS | | |
|---|---|---|
| 1 | (K + 1) | E |
| 2 | (K + 2) | B |
| 3 | (K + 3) | G |
| 4 | (K + 4) | D |
| 5 | (K + 5) | Z |
| 6 | (K + 6) | F |
| 7 | (K + 7) | C |
| 8 | (K + 8) | H |
| 9 | (K + 9) | I |
| 10 | (K + 10) | N |
| 11 | (K + 11) | K |
| 12 | (K + 12) | L |
| 13 | (K + 13) | M |
| 14 | (K + 14) | J |
| 15 | (K + 15) | O |
| 16 | (K + 16) | P |
| 17 | (K + 17) | Q |
| 18 | (K + 18) | R |
| 19 | (K + 19) | S |
| 20 | (K + 20) | T |
| 21 | (K + 21) | U |
| 22 | (K + 23) | V |
| 23 | (K + 23) | W |
| 24 | (K + 24) | X |
| 25 | (K + 25) | Y |
| 26 | (K + 26) | A |

| TABLE ENTRY | | |
|---|---|---|
| E | TABLE POINTER | (41) |
| | DEFAULT | (Ø) |
| IZE | START ADDRESS | (245) |
| D | TABLE POINTER | (36) |
| | DEFAULT | (Ø) |
| | DEFAULT | (Ø) |
| C | TABLE POINTER | (51) |
| H | TABLE POINTER | (46) |
| I | TABLE POINTER | (74) |
| N | TABLE POINTER | (111) |
| | DEFAULT | (Ø) |
| L | TABLE POINTER | (97) |
| M | TABLE POINTER | (102) |
| | DEFAULT | (Ø) |
| O | TABLE POINTER | (126) |
| P | TABLE POINTER | (131) |
| | DEFAULT | (Ø) |
| R | TABLE POINTER | (134) |
| S | TABLE POINTER | (165) |
| T | TABLE POINTER | (176) |
| U | TABLE POINTER | (183) |
| ISE | START ADDRESS | (242) |
| ISE | START ADDRESS | (242) |
| CEED | START ADDRESS | (235) |
| | DEFAULT | (Ø) |
| A | TABLE POINTER | (27) |

FIG 13A

| ALPHA SEQUENCE ID | | |
|---|---|---|
| LAST COMPARE FLAG | EXCEPTION FLAG | ADDRESS POINTER |

FIG 13B

"A" TABLE ENTRY

| ADDRESS | | | |
|---|---|---|---|
| K + 27 | 101 | | |
| K + 28 | 0 | 1 | Ø |
| K + 29 | 55 | | |
| K + 30 | 0 | 0 | 21 (SION) |
| K + 31 | 67 | | |
| K + 32 | 0 | 1 | 6 |
| K + 33 | 72 | | |
| K + 34 | 1 | 1 | 3 |
| K + 35 | 252 (TION) | | |

"D" TABLE ENTRY

| ADDRESS | | | |
|---|---|---|---|
| K + 36 | 87 | | |
| K + 37 | 0 | 0 | 15 (ISE) |
| K + 38 | 90 | | |
| K + 39 | 1 | 0 | 15 (ISE) |
| K + 40 | 245 (IZE) | | |

"E" TABLE ENTRY

| ADDRESS | | | |
|---|---|---|---|
| K + 41 | 64 | | |
| K + 42 | 0 | 0 | 25 (TION) |
| K + 43 | 39 | | |
| K + 44 | 1 | 0 | 21 (SION) |
| K + 45 | 231 (CEDE) | | |

"H" TABLE ENTRY

| ADDRESS | | | |
|---|---|---|---|
| K + 46 | 110 | | |
| K + 47 | 0 | 0 | 18 (IZE) |
| K + 48 | 127 | | |
| K + 49 | 1 | 0 | 18 (IZE) |
| K + 50 | 242 (ISE) | | |

"C" TABLE ENTRY

| ADDRESS | | | |
|---|---|---|---|
| K + 51 | 47 | | |
| K + 52 | 0 | 0 | 8 (CEED) |
| K + 53 | 33 | | |
| K + 54 | 0 | 1 | 12 |
| K + 55 | 67 | | |
| K + 56 | 0 | 0 | 18 (IZE) |
| K + 57 | 70 | | |
| K + 58 | 0 | 0 | 18 (IZE) |
| K + 59 | 83 | | |
| K + 60 | 0 | 0 | 18 (IZE) |
| K + 61 | 105 | | |
| K + 62 | 0 | 0 | 18 (IZE) |
| K + 63 | 82 | | |
| K + 64 | 0 | 0 | 15 (ISE) |
| K + 65 | 32 | | |
| K + 66 | 0 | 0 | 15 (ISE) |
| K + 67 | 51 | | |
| K + 68 | 0 | 1 | 9 |
| K + 69 | 65 | | |
| K + 70 | 0 | 0 | 15 (ISE) |
| K + 71 | 26 | | |
| K + 72 | 1 | 0 | 15 (ISE) |
| K + 73 | 252 (TION) | | |

FIG 13C

| ADDRESS | "I" TABLE ENTRY |
|---|---|
| K +74 | 55 |
| K +75 | 0 0 21 (SION) |
| K +76 | 44 |
| K +77 | 0 0 21 (SION) |
| K +78 | 21 |
| K +79 | 0 0 21 (SION) |
| K +80 | 32 |
| K +81 | 0 0 21 (SION) |
| K +82 | 40 |
| K +83 | 0 0 21 (SION) |
| K +84 | 51 |
| K +85 | 0 0 21 (SION) |
| K +86 | 50 |
| K +87 | 0 0 21 (SION) |
| K +88 | 86 |
| K +89 | 0 0 21 (SION) |
| K +90 | 106 |
| K +91 | 0 0 21 (SION) |
| K +92 | 65 |
| K +93 | 0 0 21 (SION) |
| K +94 | 31 |
| K +95 | 1 0 21 (SION) |
| K +96 | 252 (TION) |

| ADDRESS | "L" TABLE ENTRY |
|---|---|
| K +97 | 74 |
| K +98 | 0 0 12 (YZE) |
| K +99 | 98 |
| K +100 | 1 0 12 (YZE) |
| K +101 | 245 (IZE) |

| ADDRESS | "M" TABLE ENTRY |
|---|---|
| K +102 | 97 |
| K +103 | 0 0 15 (ISE) |
| K +104 | 18 |
| K +105 | 0 0 15 (ISE) |
| K +106 | 48 |
| K +107 | 0 0 15 (ISE) |
| K +108 | 71 |
| K +109 | 1 0 15 (ISE) |
| K +110 | 245 (IZE) |

| ADDRESS | "N" TABLE ENTRY |
|---|---|
| K +111 | 32 |
| K +112 | 0 0 4 (CEDE) |
| K +113 | 77 |
| K +114 | 0 0 25 (TION) |
| K +115 | 65 |
| K +116 | 0 1 17 |
| K +117 | 91 |
| K +118 | 0 1 14 |
| K +119 | 52 |
| K +120 | 0 0 25 (TION) |
| K +121 | 50 |
| K +122 | 0 0 25 (TION) |
| K +123 | 24 |
| K +124 | 1 0 25 (TION) |
| K +125 | 245 (IZE) |

| ADDRESS | "O" TABLE ENTRY |
|---|---|
| K +126 | 49 |
| K +127 | 0 0 8 (CEED) |
| K +128 | 68 |
| K +129 | 1 0 21 (SION) |
| K +130 | 252 (TION) |

| ADDRESS | "P" TABLE ENTRY | | |
|---|---|---|---|
| K +131 | 40 | | |
| K +132 | 1 | 0 | 15 (ISE) |
| K +133 | 252 (TION) | | |

| ADDRESS | "R" TABLE ENTRY | | |
|---|---|---|---|
| K +134 | 75 | | |
| K +135 | 0 | 0 | Ø (SEDE) |
| K +136 | 58 | | |
| K +137 | 0 | 0 | 4 (CEDE) |
| K +138 | 57 | | |
| K +139 | 0 | 0 | 25 (TION) |
| K +140 | 49 | | |
| K +141 | 0 | 0 | 25 (TION) |
| K +142 | 73 | | |
| K +143 | 0 | 0 | 21 (SION) |
| K +144 | 71 | | |
| K +145 | 0 | 0 | 21 (SION) |
| K +146 | 83 | | |
| K +147 | 0 | 0 | 21 (SION) |
| K +148 | 41 | | |
| K +149 | 0 | 0 | 21 (SION) |
| K +150 | 44 | | |
| K +151 | 0 | 0 | 15 (ISE) |
| K +152 | 69 | | |
| K +153 | 0 | 0 | 15 (ISE) |
| K +154 | 59 | | |
| K +155 | 0 | 0 | 15 (ISE) |
| K +156 | 48 | | |
| K +157 | 0 | 0 | 15 (ISE) |
| K +158 | 84 | | |
| K +159 | 0 | 0 | 15 (ISE) |
| K +160 | 18 | | |
| K +161 | 0 | 0 | 15 (ISE) |
| K +162 | 92 | | |
| K +163 | 1 | 0 | 15 (ISE) |
| K +164 | 245 (IZE) | | |

FIG 13D

| ADDRESS | "S" TABLE ENTRY | | |
|---|---|---|---|
| K +165 | 58 | | |
| K +166 | 0 | 1 | 23 |
| K +167 | 66 | | |
| K +168 | 0 | 0 | 25 (TION) |
| K +169 | 83 | | |
| K +170 | 0 | 1 | 20 |
| K +171 | 112 | | |
| K +172 | 0 | 0 | 18 (IZE) |
| K +173 | 19 | | |
| K +174 | 1 | 0 | 18 (IZE) |
| K +175 | 248 (SION) | | |

| ADDRESS | "T" TABLE ENTRY | | |
|---|---|---|---|
| K +176 | 91 | | |
| K +177 | 0 | 0 | 15 (ISE) |
| K +178 | 80 | | |
| K +179 | 0 | 0 | 15 (ISE) |
| K +180 | 66 | | |
| K +181 | 1 | 0 | 15 (ISE) |
| K +182 | 245 (IZE) | | |

| ADDRESS | "U" TABLE ENTRY | | |
|---|---|---|---|
| K +183 | 56 | | |
| K +184 | 0 | 0 | 15 (ISE) |
| K +185 | 59 | | |
| K +186 | 0 | 0 | 21 (SION) |
| K +187 | 67 | | |
| K +188 | 0 | 0 | 21 (SION) |
| K +189 | 72 | | |
| K +190 | 0 | 0 | 21 (SION) |
| K +191 | 84 | | |
| K +192 | 0 | 0 | 21 (SION) |
| K +193 | 59 | | |
| K +194 | 0 | 0 | 21 (SION) |
| K +195 | 78 | | |
| K +196 | 0 | 0 | 21 (SION) |
| K +197 | 120 | | |
| K +198 | 1 | 0 | 21 (SION) |
| K +199 | 252 (TION) | | |

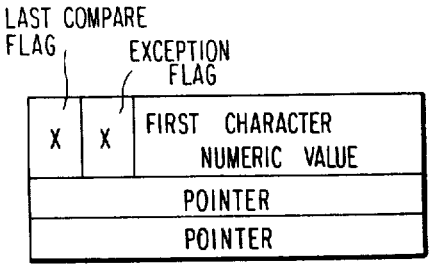

FIG 14A

FIG 14B

| ADDRESS | EXCEPTION TABLE | | | |
|---|---|---|---|---|
| T + 0 | 1 | 0 | P = 16 | A-101 EXCEPTIONS |
| T + 1 | | | 248 (SION) | |
| T + 2 | | | 252 (TION) | |
| T + 3 | 1 | 0 | A = 26 | A-72 EXCEPTIONS |
| T + 4 | | | 248 (SION) | |
| T + 5 | | | 252 (TION) | |
| T + 6 | 1 | 0 | O = 15 | A-67 EXCEPTIONS |
| T + 7 | | | 252 (TION) | |
| T + 8 | | | 248 (SION) | |
| T + 9 | 1 | 0 | I = 9 | C-51 EXCEPTIONS |
| T + 10 | | | 252 (TION) | |
| T + 11 | | | 242 (ISE) | |
| T + 12 | 1 | 1 | A = 26 | C-33 EXCEPTIONS |
| T + 13 | DEFAULT | | | |
| T + 14 | 1 | 0 | R = 18 | N-91 EXCEPTIONS |
| T + 15 | | | 245 (IZE) | |
| T + 16 | | | 252 (TION) | |
| T + 17 | 1 | 0 | M = 13 | N-65 EXCEPTIONS |
| T + 18 | | | 245 (IZE) | |
| T + 19 | | | 252 (TION) | |
| T + 20 | 1 | 0 | S = 19 | S-83 EXCEPTIONS |
| T + 21 | | | 248 (SION) | |
| T + 22 | | | 245 (IZE) | |
| T + 23 | 1 | 0 | C = 7 | S-58 EXCEPTIONS |
| T + 24 | | | 248 (SION) | |
| T + 25 | | | 252 (TION) | |

FIG 15

| ADDRESS | WORD ENDING OUTPUT TABLE | |
|---|---|---|
| K + 227 | 0 | S |
| K + 228 | 0 | E |
| K + 229 | 0 | D |
| K + 230 | 1 | E |
| K + 231 | 0 | C |
| K + 232 | 0 | E |
| K + 233 | 0 | D |
| K + 234 | 1 | E |
| K + 235 | 0 | C |
| K + 236 | 0 | E |
| K + 237 | 0 | E |
| K + 238 | 1 | D |
| K + 239 | 0 | Y |
| K + 240 | 0 | Z |
| K + 241 | 1 | E |
| K + 242 | 0 | I |
| K + 243 | 0 | S |
| K + 244 | 1 | E |
| K + 245 | 0 | I |
| K + 246 | 0 | Z |
| K + 247 | 1 | E |
| K + 248 | 0 | S |
| K + 249 | 0 | I |
| K + 250 | 0 | O |
| K + 251 | 1 | N |
| K + 252 | 0 | T |
| K + 253 | 0 | I |
| K + 254 | 0 | O |
| K + 255 | 1 | N |

STOP CODE FOR CHARACTER STRING OUTPUT PROCESSING

TEXT RECORDER WITH AUTOMATIC WORD ENDING

FIELD OF THE INVENTION

The present invention deals with improvements in text recorders, i.e., typewriter or typewriter-like devices which may produce intelligible text of printed form or a text display by the use of a CRT or the like, or both.

RELATED APPLICATIONS

The present application is an improvement of the device disclosed in our copending application entitled "Multi-Character-Display Controller for Text Recorder", Ser. No. 107,467 Filed Dec. 26, 1979, now abandoned in favor of continuation application Ser. No. 393,981 filed June 30, 1982.

BACKGROUND OF THE INVENTION

As described in our above-referenced application, there have been many suggestions made to improve keyboarding efficiency in typewriter and typewriter-like devices. In addition to the prior art mentioned in the above-identified application, there have also been suggestions for devices to automatically verify the spelling of text input through a keyboard. A particular disadvantage of most such devices is the relatively vast amount of storage required, and several recent suggestions, such as those disclosed in U.S. Pat. Nos. 3,925,761 and 3,995,254, evidence an effort to reduce the required amount of storage.

The addition to the typewriter (which is itself about 100 years old), of the intelligence afforded by programmed digital computers, and even more recently by the microprocessor, allows a vast improvement in the intelligence of the device without significantly increasing the space it occupies since the microprocessor itself and its related storage devices can easily be enclosed in otherwise unused spaces within a typewriter casing.

Electronic typewriters, i.e., typewriters including digital processors, on the market today generally are comprised of three basic components. A first component is the keyboard itself which generally has an appearance similar to other conventional typewriters in that the layout of the alphanumeric keys is standard, although it may have a few additional function implementing keys. In contrast to the earlier mechanical or electro-mechanical typewriters, the function of the keyboard in the modern electronic typewriter is merely to generate a unique signal in dependence upon a particular key actuated by an operator. This signal sometimes called the keycode, is then presented to the electronics, which is the second major component in the typewriter. The function of the electronics is to interpret the keycode in order to generate character or function identifying signals which are fed to the third component, i.e., the display mechanism for the generation of alphabetic symbols, numerical symbols, punctuation marks, other graphic symbols, and the functions necessary to relate these symbols. These various symbols must be related in a format which is easily understood by a reader and this requires such functions as spacing between different symbols, spacing between words, spacing between lines, and locating symbols in an ordered sequence as determined by the operator's actuation of the various keys on the keyboard. The particular form which the character and function identifying signals take depends in large part on the form of the display or output mechanism. For example, in those typewriters which include a print ball, the character identifying signals must be such as to cause the ball to rotate and tilt to the proper orientation to locate the desired character with respect to the printed page so that when the ball is impacted, the desired character symbol will be produced. On the other hand, in those typewriters employing an ink jet printer, the character and function identifying signals may take on different characteristics, and the same character and function identifying signals for use with the CRT or the like display possess still other requirements. Inasmuch as the present invention can be employed with all of these, and other equivalent output devices, the specific form of the character and function identifying signals will not be detailed here as they are well known to those skilled in the art.

In large part, the electronic typewriter mimics the function of the electromechanical or mechanical typewriter. More particularly, in the mechanical typewriter, the operator's actuation of a specific key produced the combination of mechanical movements which resulted in a type bar carrying an image of the character associated with the actuated key impacting a type ribbon onto a page to produce an image of that character and to also allow the paper carrying carriage or a movable print carrier to be displaced so that a next character is printed adjacent the previously printed character. In other words, this mechanical typewriter translated the operator's actuation of a specific key to a specific set of mechanical movements to produce the desired image. Similarly, the electronic typewriter translates the keycode generated by the operator's actuation of the key in the keyboard to those signals necessary to produce the desired image from the particular display device being driven.

However, with the intelligence added to the typewriter by the digital processor, additional functions can be implemented; one important function is the buffering between input and output provided by a storage device contained in the electronics. Thus, most electronic typewriters include a buffer into which the keycode is stored, and sequential key actuation result in the storage of sequential keycodes identifying the keys and the sequence in which they are actuated. The output device is then driven sequentially from the keycodes read from storage and translated through the medium of a storage table correlating keycodes and character or function identifying signals.

Hereinafter when referring to electronic typewriters we use the term as equivalent to a text recorder in that "typewriter" no longer carriers the implication of a machine necessarily requiring "type" to produce a text record. By text recorder we mean any device which produces a record (whether or not permanent) of a series of text characters and symbols interrelated to convey meaningful information to a human reader.

The referred to application discloses how, under certain circumstances, the actuation of a single key can be decoded into a string of character signals, so that actuation of a single key can produce a multi-character output. The referred-to application further discloses how, under certain circumstances, the particular multi-character output produced by the actuation of a specific key can be varied. One feature of the invention disclosed in the referred-to application is that of producing a first multi-character string upon the first actuation of a specific key, and producing a second multi-character string on a second sequential actuation of the identical key. Another feature of the invention disclosed in the referred-to application is that of producing a first or second single or multi-character string upon the actuation of a specific key in dependence upon the identity of a key actuated prior to the specific key. In the context of the referred-to application, this feature allowed the multi-character text recorder to output either a suffix or a word; the suffix was produced if the previously entered key was a character and the word was produced if the previously enetered key was a function such as a space or carriage return.

The present invention is arranged to solve a related but slightly different problem and to assist in both improving keyboard efficiency by generating a multi-character signal string in response to actuation of a single key, and at the same time, insuring the correctness of the spelling of the words so typed. In particular, many word endings sound the same but are spelled differently. For example, the word endings having the sound "ceed" can be spelled "sede", "cede", or "ceed". Thus, it is an object of the present invention to provide a typewriter or text recorder for producing a multi-character signal string identifying one of plural character strings representing word endings which sound the same. The selection is made in dependence upon previously entered characters forming the remainder of the word for which the word ending is desired. Thus, for example, a typewriter or text recorder in accordance with the present invention may have a plurality of word ending keys, each associated with differently spelled word endings, all sounding the same, each key, when actuated, producing the appropriate word ending associated with the previously entered characters. While such word ending writing keys can be keys in addition to those found in the standard keyboard, they can also be incorporated within the standard keyboard by being associated with keys which are infrequently used during text typing. In those cases where the word ending writing key functions are included in the conventional keyboard, a mode key can be provided to the operator to only allow automatic word ending writing when the text recorder is in a word ending writing mode, or to prevent automatic word ending writing when the text recorder is not in a word ending writing mode. On the other hand, such a decision can be removed from the hands of the operator by incorporating within the logic of the text recorder the decision as to whether or not automatic word ending writing is appropriate which decision can also be made dependent upon previously entered keys.

Furthermore, while signals representing different word endings in each word ending group can be generated from a different key, a relatively large dictionary of word endings, some of which sound the same and others of which do not, can be produced by the actuation of a single word ending writing key, the specific word ending produced on actuation of the key being dependent upon the previously entered keys.

SUMMARY OF THE INVENTION

Thus, in accordance with the invention, an automatic word ending typewriter includes a text display device, i.e., impact printer, ink jet printer, CRT display or the like, which displays intelligible text in response to character and function identifying signals, a keyboard for actuation by an operator including a plurality of keys, each of which produces a unique keycode when actuated and a decoder responsive to the keycode signals from the keyboard for producing one of at least two groups of one or more character identifying signals in response to actuation of a selected key on the keyboard, each group of character identifying signals representing a different word ending, wherein said word ending means includes means for selecting among said groups dependent upon one or more key actuations prior to actuation of the selected key.

Different embodiments of the invention are presented, each of which, however, employ a sequential logic processor as the decoding means and in which the sequential logic processor includes the word ending means.

In one embodiment of the invention, which employs decision tree processing, a decision tree is implemented beginning with the identity of the key entered prior to actuation of the selected key. Each branch in the tree represents a previously entered key. Each node in the decision tree is represented by a table which has an entry for each branch connected to the node. Any node which is not connected to another node (i.e., no branch) identifies the desired word ending and therefore, the associated entry in the table includes identification of the desired character string forming the word ending. In the event that the node is connected to another node, instead of containing a representation of the desired character string, it contains a representation which, when summed with a representation of the next prior character, points to an entry in a further table. In effect, the decision tree processor begins within initiation of automatic word ending, retrieves from a memory an immediately prior entered character. This character keycode, or keycode related quantity directs the processor to a table entry which itself points to: (a) a selected word ending; (b) a further table or (c) a default entry. If the entry directs the processor to a further table, a further prior entered character is extracted which directs the processor to a specific entry in the further table. This entry also has the same three possibilities. Processing is carried out by sequentially retrieving prior entered characters until result (a) or (c) is achieved.

The processor determines the appropriate word ending by traveling through the decision tree from branch-to-branch until the desired word ending is located.

In another embodiment of the invention, a sum is formed of quantities unique to each alphabetic character, and cleared on selected functions or characters such as space function, numerical character or the like. When the selected key is actuated, the sum is used as a pointer to the desired word ending string.

In the third embodiment three word ending designators are available to allow ready selection among a relatively large group of word endings with minimum processing time and storage requirements.

The first designator is the identify of the key entered just prior to automatic word ending initiation. This is determined by reading from a storage buffer into which keycodes are written in the sequence that keys are actuated by the operator. In some cases the identity of the character will uniquely identify the appropriate word ending or immediately signal a default condition. In either event, processing is terminated. If the identity of the immediately preceding character is inadequate then the second designator is employed. A character preceding table (CPT) stores, for each potential character, information representing an appropriate word ending, a default condition or a pointer to a further table if this single designator cannot uniquely determine an appropriate word ending.

As each character in a word is keyed in by the operator a quantity, uniquely related to each actuated key, is added to a prior sum in an accumulator (termed the alpha sequence ID register). Thus sum, at the time automatic word ending is initiated can be used to select an appropriate word ending.

For the few cases in which the two designators are inadequate a third data item can be used to resolve the remaining conflicts. For example, this third data item can comprise the first character in the word corresponding to one of two (or more) otherwise apparently appropriate word endings. This third data item can be compared with the first character keyed in by the operator. A match or lack of match then indicates the correct word ending if there are only two available choices. The presence of three or more choices requires one or more comparisons.

The use of plural designators allows the designators to be chosen to effectively select appropriate word endings with minimum storage and processing requirements in accordance with the ensemble of allowable word endings.

In the embodiments of the invention presented herein, the representation of the word ending string pointed to, when the desired word ending has been determined, can alternatively comprise a memory area which stores the necessary character identifying signals, or on the other hand, a memory area which stores only pointers to the memory areas which already store representations of the desired character identifying signals. The latter alternative is disclosed in detail in the above-referenced copending application, in which a start address storage area stores a plurality of pointers, each pointer representing the address of a sequence of pointers, the sequence of pointers each pointing to representations of the character identifying signals.

In one form of the invention, the selected key, which generates the keycode calling for automatic word ending, may comprise a key which is used uniquely for this purpose. The key can be arranged to address all possible word endings which are automatically written, and the selection between the available word endings is determined by the characters associated with the previously actuated keys. On the other hand, a set of keys can be used, each of the keys generating a different keycode and each of them actuating automatic word ending operation. Each of these keys is associated with a different group of word ending character strings; one convenient manner of grouping the word ending character strings for each key is by grouping the word ending strings that sound alike.

A further alternative is to use multi-purpose keys to generate the keycode to actuate automatic word ending. In order to designate the desired effect of the keycode from such a multi-purpose key, a further key can be employed to place the machine in an automatic word ending mode or remove the machine from an automatic word ending mode. This mode selection key is arranged to set or reset a latch, and when the latch is set and the multi-purpose key is actuated, automatic word ending is performed. In this alternative, a single multi-purpose key can be used to address all possible word endings, or groups of word endings can be associated with different multi-purpose keys.

Finally, the multi-purpose key can be arranged to initiate automatic word ending only if a previously actuated key was a character (or a hyphen) as will be disclosed.

The case in which the word ending appears can be fixed either as upper or lower case or, preferably, the case is determined by the status of shift or shift lock signals at the time the automatic word ending actuating key is depressed. More particularly, the conventional shift or shift lock keys on the typewriter control the status of the shift and shift lock latches. When the shift key is depressed, the shift latch is set, when the shift key is released, the shift latch is reset. When the shift lock key is depressed, it is mechanically retained in its depressed condition, and a latch is set. On the next depression of the shift lock key, it is mechanically released, and the shift lock latch is reset. These latches provide shift and shift lock signals which conventionally control the case in which a character is displayed. If either the shift lock or shift latches are set, the character is displayed in upper case, if both latches are reset, the character is displayed in lower case. Preferably, the status of the shift and shift lock latches is retained (i.e., stored) at the time the automatic word ending key is actuated, and the display of the various characters in the selected character string are made in a case determined by the status of the shift and shift lock latches at the time the key actuating the automatic word ending operation is actuated.

Finally, the invention also includes the disclosed method of automatic word ending in a text recorder of the type having:

a text display for the display of text in intelligible format, a keyboard with plural alpha, numeric function and symbol graphic keys for producing a unique keycode on actuation, and decoding means responsive to the keycodes for driving said text display wherein the method comprises the steps of:

storing a CPT table representing a matrix of appropriate word ending representations as a function of a character preceding a word ending, if said preceding character uniquely identifies an appropriate word ending, addressing said CPT table with a representation of a character preceding actuation of an automatic word ending initiating key activation to identify an appropriate word ending, and employing said identification to select appropriate signals to drive said display to display said identified word ending.

BRIEF DESCRIPTION OF THE DRAWING

The present invention is now further described in the following portion of the specification to enable those of ordinary skill in the art to practice the invention, when taken in conjunction with the attached drawing in which like reference characters identify identical apparatus and in which:

FIGS. 4A-4D are block diagrams of four embodiments of a text recorder;

FIG. 5 shows a decision tree appropriate for the "ceed" sounding word endings;

FIG. 11 is a table showing frequency of occurrence of an assembly of eight word endings as a function of the character preceding the word ending;

FIG. 12 illustrates the CPT table appropriate for the third embodiment of the invention;

FIGS. 13A and 13B–D represent alpha table format and the plurality of alpha tables whose use is appropriate with the third embodiment;

FIGS. 14A and 14B illustrate the exception table format and an exception table appropriate to the third embodiment;

FIG. 15 represents the character sequence table useful for producing a character string once an appropriate start address, representing the desired word ending, has been determined;

DETAILED DESCRIPTION OF PREFERRED EMBODIMENTS

Figure 1:
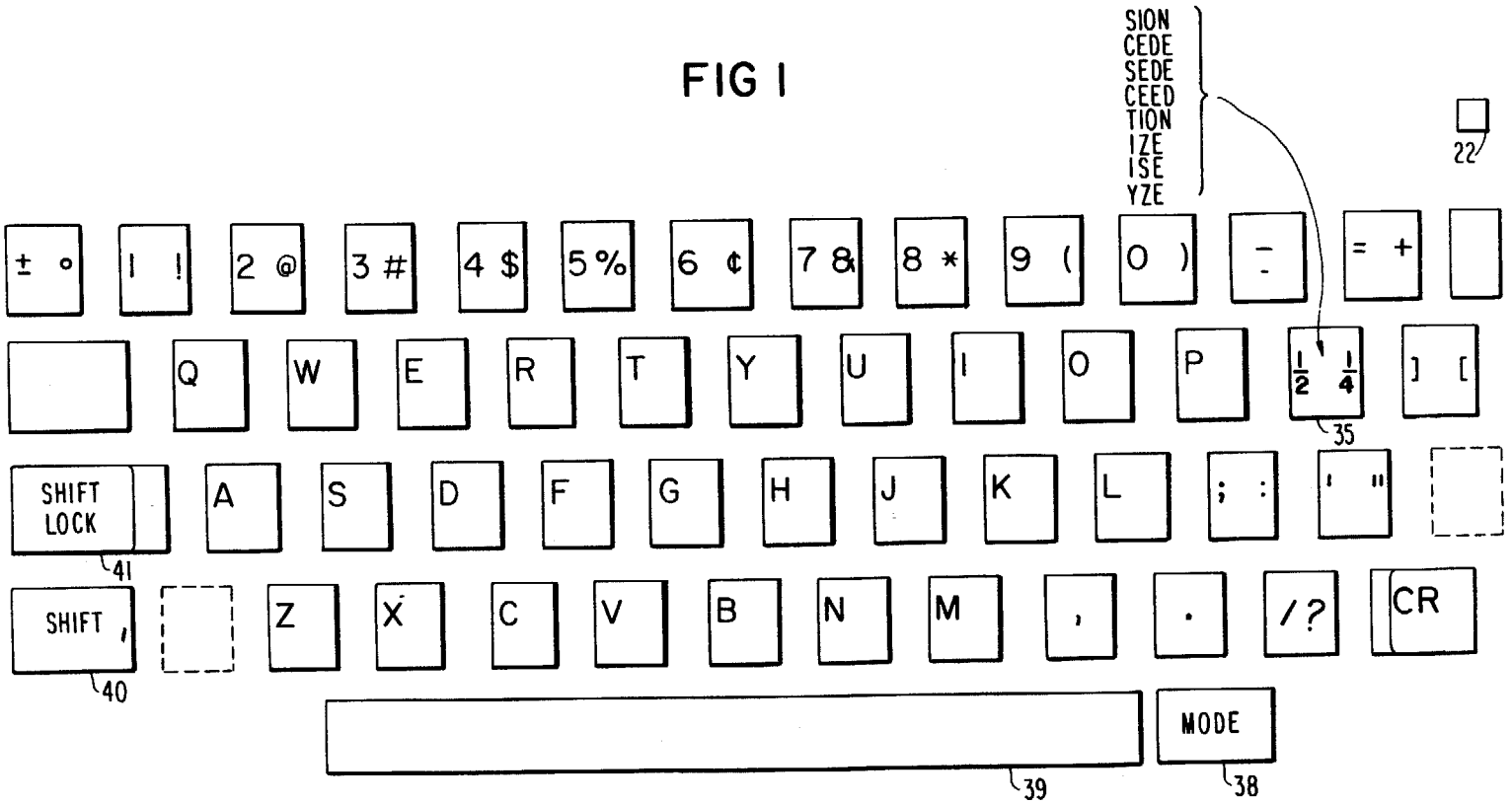
FIGS. 1, 2, 3A and 3B illustrate different arrangements of a typewriter keyboard for use with the present invention.

FIG. 1 illustrates a text recorder keyboard laid out in accordance with a preferred embodiment of the invention to execute automatic word ending operation. As shown in FIG. 1, the layout of the alpha-numeric keys and function keys for conventional typewriter operation is conventional. The key CR represents the carrier return or line ending key, depression of which initiates that function. FIG. 1 illustrates three variations over such a conventional arrangement; firstly, a word ending mode key 38 is illustrated which, when actuated, will change the mode of the text recorder from automatic word ending to non-automatic word ending and vice versa. Of course, the location of the key 38 in the illustrated keyboard is subject to wide variations. Secondly, the fraction key 35, the key to the right of the "p" character key, will, when actuated in the word ending writing mode, produce the character identifying signals appropriate to the previously executed character keys, such as the multi-character word endings "cede", "sede", "ceed", "tion", "sion", "ize", "ise", or "yze". Finally, indicator 22 such as a light emitting diode, is available within the operator's viewing area to indicate whether or not the text recorder is in the automatic word ending mode. Indicator 22 may be energized or de-energized on alternate actuations of key 38.

In operation, in the automatic word ending mode, that is, with the indicator 22 illuminated, assume the operator actuates the keys corresponding to characters "pre" and then actuates key 35. In response to sequential actuation of the keys "pre", the text recorder will display the characters "pre". Furthermore, coded signals representing the actuated keys are stored in the order of their actuation. When key 35 is actuated, the text recorder determines that it is in the automatic word ending mode and therefore, display of either of the fraction characters ½ or ¼ is inhibited. Rather, the text recorder identifies the previously actuated key (e) and determines the appropriate word ending string, or determines that the appropriate word ending string cannot be determined from the identity of the previously entered key and therefore, further processing is initiated which may examine the key (r) entered previous to the previously entered key. This process continues until the appropriate word ending string is identified from one or more previously entered keys or other processing to be disclosed herein. When the identity of the appropriate word ending is accomplished, the appropriate word ending is displayed adjacent to the previously entered characters. In the example described, the appropriate word ending to the characters "pre" is "cede".

The case of the automatically displayed word ending characters is also determined by the text recorder in response to the status of shift lock and shift signals, which status is controlled respectively by the shift lock key 41 and the shift key 40.

In the event that key 35 is actuated when the automatic text recorder is not in the automatic word ending mode, then the appropriate fraction character, either ½ or ¼, will be displayed depending upon the status of the shift and shift lock signals, as is conventional in the prior art typewriters. It is also within the scope of the invention to allow the recorder to determine upon actuation of key 35, whether automatic word ending is appropriate. This can be determined from the previously entered key. If it is an alpha character and the automatic word ending is appropriate the word ending is induced. On the other hand, if previous key is a space function or a key other than an appropriate alpha character the recorder defaults to the fraction display.

Figure 2:
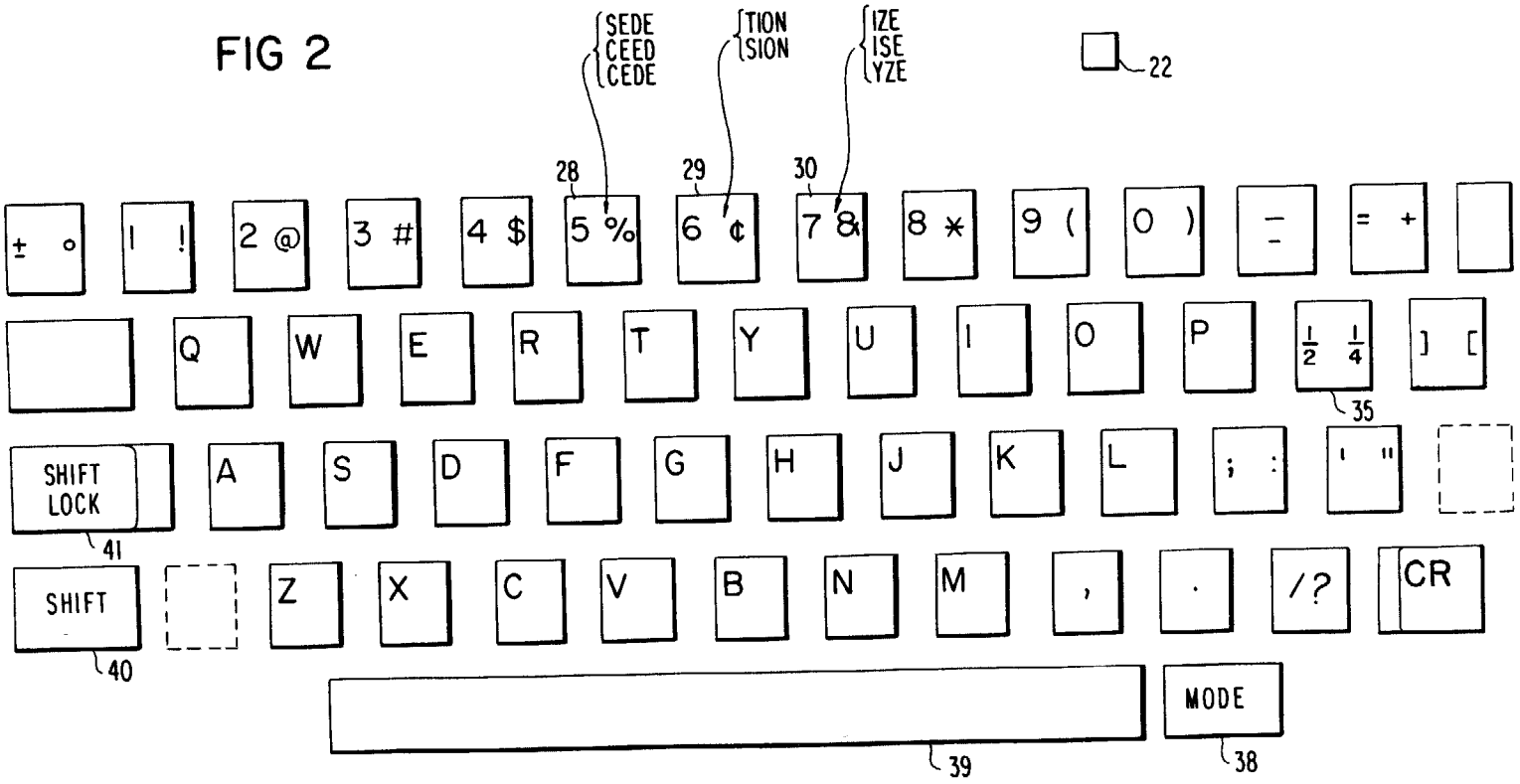

FIG. 2 is an alternate arrangement for the keyboard according to the present invention. The keyboard of FIG. 2 is identical to the keyboard of FIG. 1 with the exception that the fraction key 35 is no longer associated with the automatic word ending operation. Rather, the numeral keys 28–30 are now associated with the automatic word ending mode, wherein key 28 is associated with a group of three word endings, key 29 is associated with another group of two word endings and key 30 is associated with a third group of three word endings. Automatic word ending operation is available when the text recorder is in the automatic word ending mode, much as in the example described in connection with FIG. 1. However, when any of keys 28–30 is actuated in the automatic word ending mode, only one group of word endings will be examined to determine the appropriate word ending.

Figure 3A:
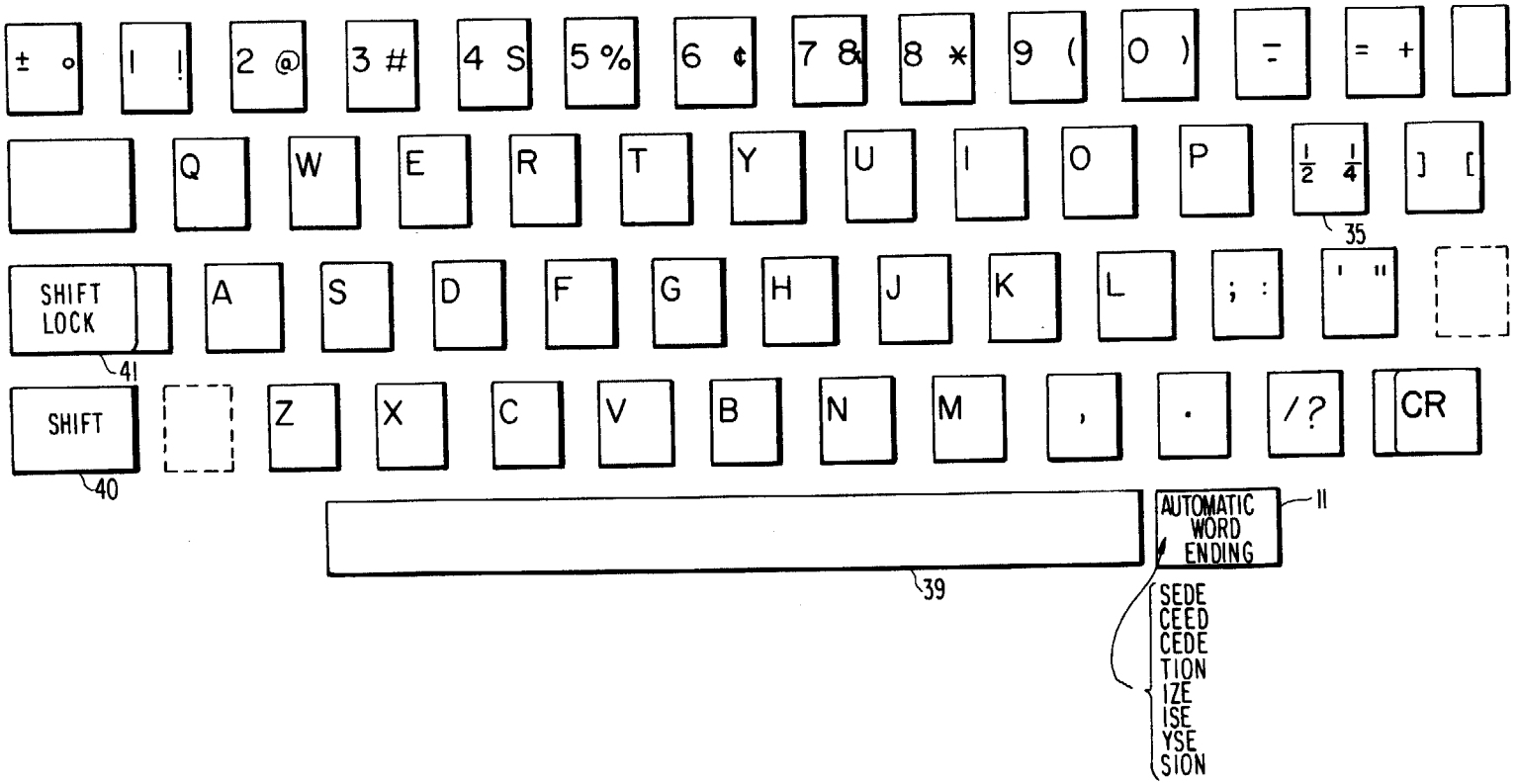
Figure 3B:
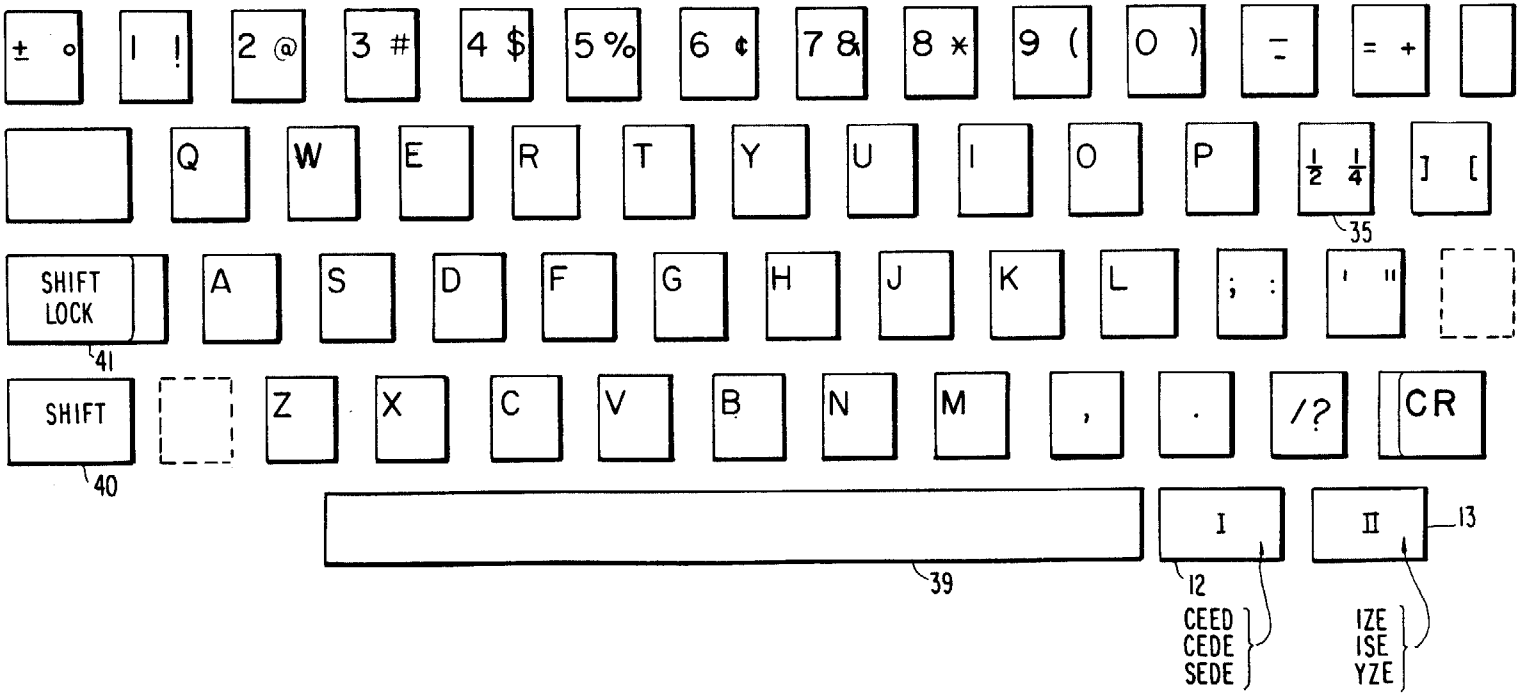

FIGS. 3A and 3B show two further keyboards in accordance with the present invention. The keyboard of FIGS. 3A and 3B differ from the keyboards of FIGS. 1 and 2 in that the word ending mode key 38 has been eliminated. Rather, the keyboard of FIG. 3A incorporates an automatic word ending key 11 which, when actuated, will initiate the automatic word ending to select among a large group of possible word endings, some of which sound alike, and others of which do not. FIG. 3B is a further alternative in which the word ending key 11 of FIG. 3A has been replaced by a I key 12 and a II key 13. As is implied in FIG. 3B, when I key 12 is actuated, an appropriate word ending from the group "ceed", "cede", or "sede" will be selected and displayed depending upon the previously entered character or characters. Similarly, when II key 13 is actuated, the appropriate word ending among the possible word endings "ize", "ise" or "yze" will be selected and displayed, depending upon the identity of one or more previously entered characters.

Figure 4A:
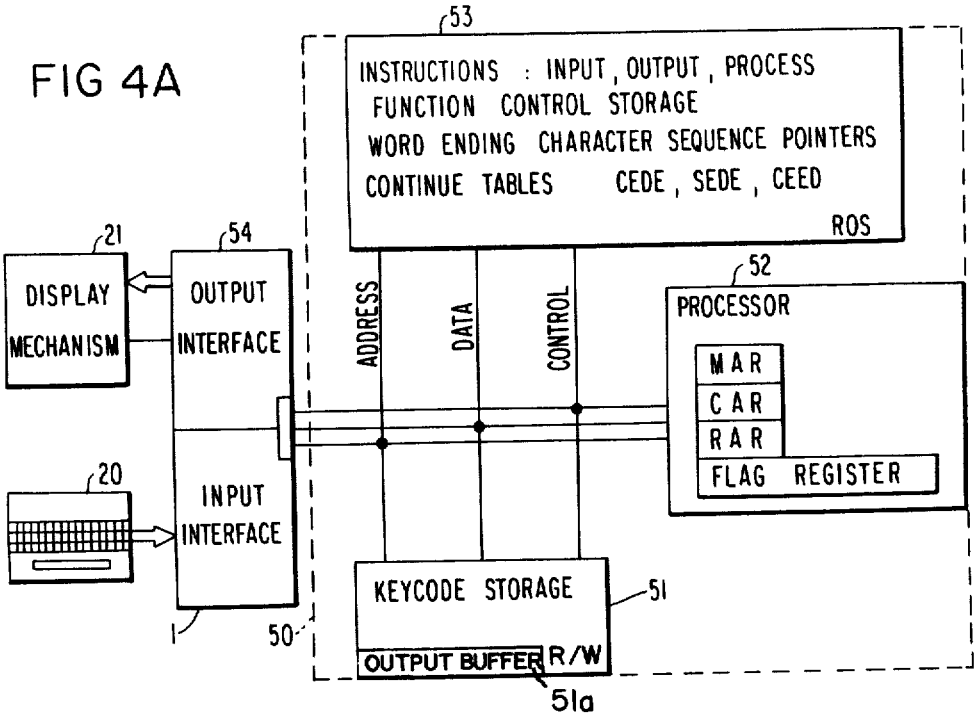

One embodiment of the automatic word ending text recorder of the invention is illustrated in block diagram fashion in FIG. 4A. The keyboard 20 shown in FIG. 4A can be of any of the keyboards illustrated in FIGS. 1, 2, 3A or 3B. Each of the keys in the keyboard 20 when actuated produces, in a keyboard interface 1, a multi-bit code (keycode) representative of an actuated key. The display 21 is driven by the interface 54, and can comprise a hard copy printer of any of a plurality of conventional such printers, or a CRT display or the like, also conventional. The digital processor 50, illustrated in FIG. 4A, is employed to respond to each of the different keycodes provided by the interface 1, and to output the necessary character and function identifying signals to the interface 54 to appropriately drive the display 21. While a preferred embodiment employs a microprocessor, which is preferable from the size standpoint, those skilled in the art will understand that other digital processors could be used instead.

As shown in FIG. 4A, the digital processor 50 is coupled to the keyboard interface 1, and to the output interface 54 via data, address and control lines. The digital processor 50 includes a sequential logic processor (microprocessor) 52 and a read only storage (ROS) device 53. Also coupled to the data, address and control lines of the microprocessor 52 is a read/write storage (R/W) device 51.

Preferably, the read only storage device 53 embodies, in coded form, a set of predetermined responses for the processor 52 as well as fixed data which will be defined hereinafter. For example, and as is explained in the above-referenced application, the fixed data may include data corresponding to the function control storage (translating keycodes to character and function identifying signals), files containing pointer information for pointing to specific locations in the function control storage, etc. The read/write storage device 51, on the other hand, may include reserved areas for the storage of the keycode of the keystroke being processed, as well as keystrokes awaiting processing, and in addition, an area reserved for previous key entry or entries.

Before describing the operation of the inventive automatic word ending apparatus, normal operation of an electronic typewriter of the form generally shown in FIG. 4A will be discussed.

When a key in the keyboard 20 is depressed, the contact closures, in connection with the keyboard interface 1, generate a multi-bit code, called a keycode, which is unique to the actuated key. The microprocessor 52 responds to recognition of the keycode firstly by storing the keycode, in an area set aside for the present keycode. Once the keycode is stored, the processing of the keycode is begun. Typically, the processing is limited to determining the corresponding character or function identifying signals which will be output to the interface 54 to drive the display 21. This translation of the coding function is effected by employing the keycode as an address into a reserved area of the ROS device 53 (function control storage), at which the corresponding character or function identifying signals are stored. While normally the processing of the keycode entry is rapid, the processing of some entries may require significant amounts of time and therefore, the input/output operations may be interrupted to store a subsequent keycode. By appropriate use of pointers, the microprocessor 52 can keep track of the location of present keycode being processed so that subsequent keycodes can be processed in the order of their receipt. At some time in the processing of a keycode it is also stored in R/W storage device 51 in an area reserved for the line (or other length) of text that is being generated. Thus, the R/W storage device 51 may retain plural keycodes, for example, those entered between the first index, to start a line, and a second index, to terminate display of a line and to begin operations on another line. Thus, not only does the microprocessor 52 keep track of the keycodes being processed, but it can also refer to previous keycodes entered in the same line of type or in some other length text string.

The read only storage device 53, in addition to containing the various tables which will be described hereinafter contains the instructions for keycode and display processing routines which, in effect, personalize the processor 52 and provide it with the desired characteristics. Those portions of the processing routines which merely store the keycode in the R/W storage device 51 and increment the pointer to the next available keycode storage location, as well as the output processing functions which select a decoded or translated character or function signal and provide it to the interface 54 for display purposes, will not be described herein inasmuch as those functions are well known to those skilled in the art. The intermediate functions, however, namely, those of extracting the keycode from the R/W storage device 51 and translating that code into a character or function signal or a multi-character signal for automatic word ending in accordance with the present invention will be described herein. Before describing that processing, we will now describe the various reserved areas in the read only storage device 53 which are used during that processing.

A first reserved area in read only storage device 53 corresponds to the function control storage 6 of the above-referenced application. This reserved area is addressed by a keycode, either directly, indirectly or in a relative fashion, and stored at the corresponding location is the respective character or function signal necessary to drive the display 21. Thus, for example, at the location corresponding to a space keycode would be those signals necessary to escape the display print point (the point at which the next symbol will be located) in the case of an impact printer or similar function in the case of a CRT or ink jet printer. Likewise, the entries for characters, in addition to allowing the spacing function to proceed after printing or display, provide for printing or display of the appropriate character, and the case (upper or lower) may be determined by a control signal which accompanies the character identifying signal or may be derived from the function control storage area itself.

DECISION TREE EMBODIMENT

In addition to these areas, a decision tree processor embodiment includes one or more control tables for the possible word endings, to implement the decision tree processor. Before discussing the makeup of those control tables, reference is made to FIG. 5 to illustrate the decision tree for the word endings "ceed", "sede" and "cede".

As shown in FIG. 5, actuation of the automatic word ending operation (AWO) directs processing to begin at a node N1. At node N1, seven possible paths (branches) can be taken depending upon the previously actuated key; branches are provided for any of the characters R,O,E,X,N,C. If the preceding keycode is none of those, that is, for example, if the automatic word ending is initiated after a space operation, for example, the decision tree can not determine an appropriate word ending since none of the available word endings would be appropriate, and thus, a default location is also available. Thus, from the node N1, depending upon the previously entered keycode, certain branches of the tree lead directly to an appropriate word ending, i.e., the branches corresponding to keycodes of O,E,X and N. However, if the previously entered character corresponds to an R or C, node N1 is connected to nodes N2 and N3, node N2 associated with a previously entered R, and node N3 associated with a previously entered C.

If the previously entered character was R, then from node N2 two branches are available, either a default branch or a branch corresponding to an E entered prior to the R. This branch leads to node N4. Node N4 has has three branches available to it, one a default branch and the others corresponding to the characters P and T preceding the E, each associated with an appropriate word ending. Thus, for example, if the three prior characters are TER, then the appropriate word ending is "cede" (corresponding to the word intercede) and if the previously entered characters are PER then the appropriate word ending is "sede" (corresponding to the word supersede). Similarly, node N3 has three branches available to it, a first branch which is a default branch, a second branch corresponding to a previously entered A character, and a third branch corresponding to a previously entered U character. Thus, if the previously entered two characters are UC, the appropriate word ending is "ceed" (corresponding to the word succeed) and if the previously entered characters are AC, then the appropriate word ending is "cede" corresponding to the word "accede".

It should also be understood that some of the branches on the tree actually correspond to multiple words. That is, for example, the E branch (from node N1) provides the appropriate word ending (cede) when the previously entered character is an E and this can correspond to any of the words "precede", "recede", "secede" or "antecede".

From the foregoing it should be appreciated how the decision tree can be built up for any group of similarly sounding word endings, or for any group of word endings which can be distinguished from one another.

Figure 6:
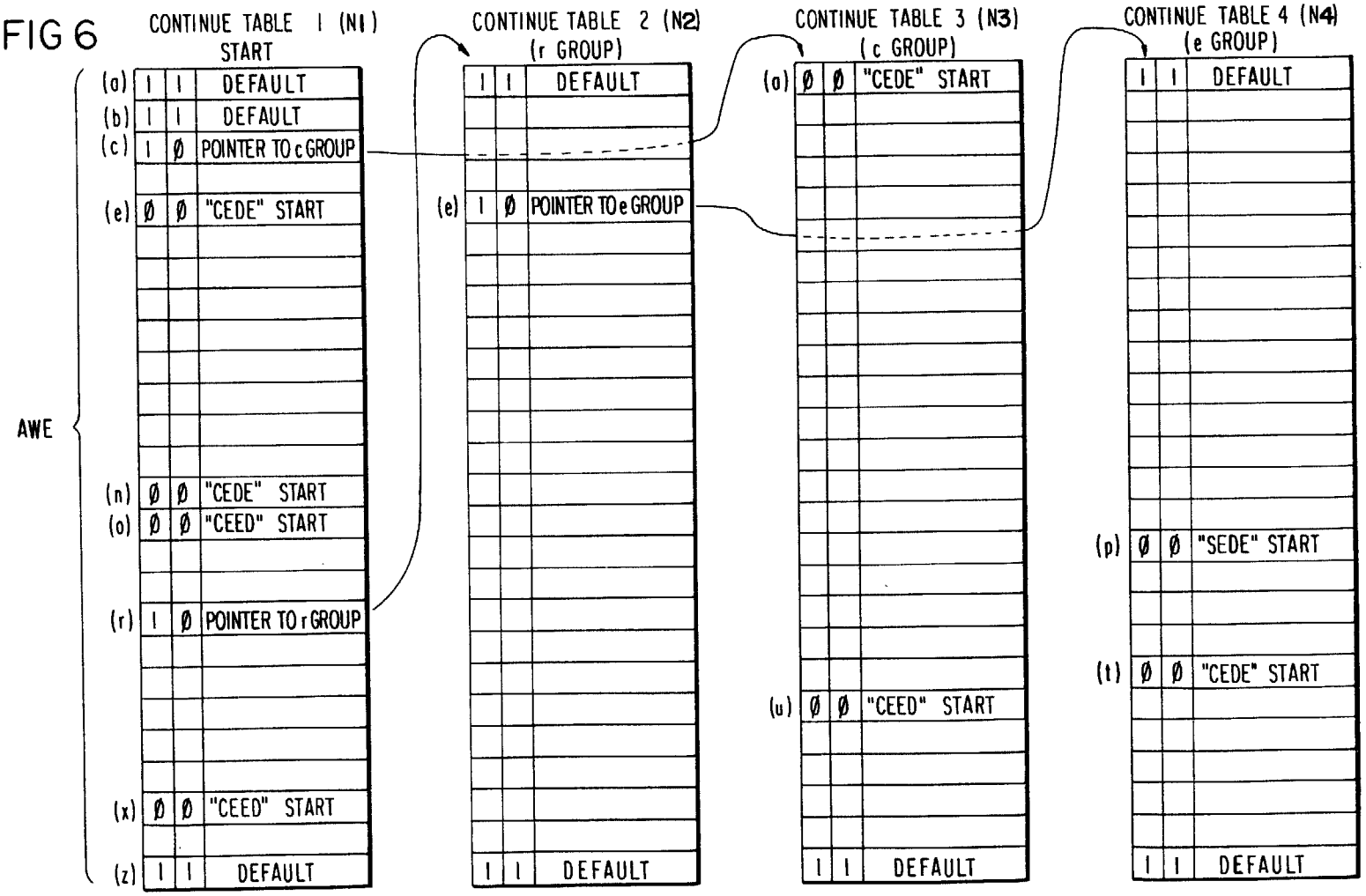
FIG. 6 illustrates a table appropriate for the decision tree of FIG. 5.

FIG. 6 illustrates Continue Tables 1 through 4 to implement the decision tree processing of FIG. 5. Each of the Continue Tables comprises a reserved area in the read only storage device 53, each entry comprising a multi-bit entry including a pair of flags and a pointer. The pointer may point to a further table or to a further reserved area in the read only storage device 53 which represents the desired word ending. Referring now to FIG. 6 and Tables 1 and 3 therein, (corresponding to nodes N1 and N3 of the decision tree) it will be seen that Table 1 includes an entry for each different branch of the node N1. The C branch entry includes a flag combination 10, and a pointer to Table 3 (corresponding to node 3). The R branch includes the same flag combination 10 and a pointer to the R group, i.e., Table 2, corresponding to node N2. The E and N branches of Table 1 include the flag combination 00, and a pointer to a representation of the "cede" word ending. The O and X branches include similar flags and a pointer to the "ceed" word ending. Finally, each other entry (only some of which are shown) corresponds to the last branch and contains a default entry indicating that no appropriate word ending is available.

The C group entry at Table 1 points to a reserved area corresponding to Table 3 (representing node N3) and in the course of processing a particular entry a pointer will be developed to a specific entry in Table 3 depending on the character entered previous to the C. If that character was an A, then the A entry of Table 3 is pointed to, if the previous character was a U, then the U entry is pointed to, and if the previous character is something other than that, one of the default entries is pointed to. The A entry in Table 3 includes the flag combination 00 and a representation of the word ending "cede". The U entry includes the flag combination 00 and a representation of the "ceed" word ending. In a similar fashion, the R entry in Table 1 points to Table 2 (representing node N2). One entry in Table 2 points to Table 4 (representing node N4) which includes entries for characters P, T and a default entry for any other character.

The two flags provide for four different possibilities. Flag 00 indicates that the decision tree processing is complete, and an appropriate word ending has been identified. Flag 01 indicates a short word with an identified word ending. Flag 10 indicates the process is not yet complete and the associated pointer is to another Table. Finally, the flag combination 11, indicates a default, i.e., no appropriate word ending is available.

In order to enable this processing the processor 52 must be able to distinguish prior key entries and use their identity to address appropriate locations in the Table. To that end, each different keycode is assigned a unique number and a register in the processor 52 is set aside to operate as a Continue Address Register (CAR). For example, the CAR can be two bytes in length and can be used as an accumulator in which the previous contents of CAR are summed with a unique quantity representing a keycode to derive a new CAR quantity. In order to insure that the CAR register maintains a relevant quantity, it is cleared (set) to a value of 1 on power on, or activation of a key corresponding to a function, numeric, symbol and most punctuation marks.

For representing each different keycode for purposes of decision tree processing, any unique numeric quantity can be assigned to different keycodes, for example, the keycode itself may be used as a numeric quantity. For purposes of explanation, we will assign, in sequence, even numbers beginning with 0, for keycode corresponding to A, through the numeric quantity 50 for the keycode corresponding to the character Z. Thus, the characters C, E, N, O, R and X correspond to the numeric quantities 4, 8, 26, 28, 34 and 46, respectively.

When the automatic word ending operation is initiated, the CAR includes a quantity of 1, since it is cleared to that state on power on or selection of any function, numeric or most symbol graphics. A further register in the processor 52, the Retrieval Address Register (RAR) is initially loaded with the address at which the keycode corresponding to the automatic word ending key entry is stored. This address is then decremented by 1 so as to address the immediately preceding location and the corresponding keycode quantity (for example C) is extracted and added to the CAR. Thus, the entries shown in FIG. 6 in the Continue Table 1 are located at addresses of 5, 9, 27, 29, 35 and 47, respectively.

In the course of processing, when the continue flag combination 10 is detected (for example C), the RAR is again decremented so that it points to the immediately preceding character. At the same time, the flag bits are stripped from the contents of the location and the pointer located there is inserted into the CAR, and that quantity is summed with the quantity corresponding the keycode pointed to by the RAR so as to point to a specific location in the next appropriate table.

In this fashion, the table entry of a node is selected based upon the character, and if that information is inadequate to determine an appropriate word ending, the contents of the Table point to another Table, and a specific entry in that table is located by the quantity corresponding to the immediately prior character. This processing continues in serial fashion until a default entry is detected or a continue flag 00 combination is detected which indicates that the corresponding pointer points to the representation of an appropriate word ending.

In order to decrease the processing time, and the necessary storage, the generation of a pointer from one table to another can be preceded by a test to determine if the preceding character corresponds to a specific entry in the table. If it does not, then a default can be indicated, thus saving space otherwise required for storage of plural default indications.

Figure 8:
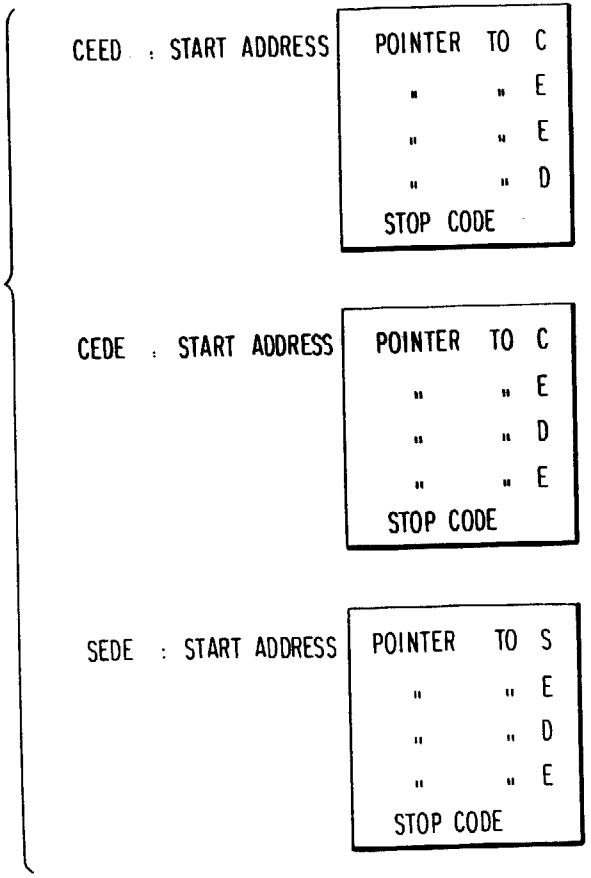
FIGS. 8 and 9 illustrate the start address tables with the pointers to function control storage.

Once a flag combination 00 is detected, indicating that the associated entry represents a word ending, a further reserved area can include representations of the character identifying signals necessary to drive the display 21 to output the desired word ending. However, this would duplicate the function control storage area of the read only storage device 53. Therefore, preferably, each table entry associated with the flags 00 can comprise a start address which refers to a sequence of pointers, pointing to the desired character identifying signal stored in the function control storage area of read only storage device 53. Once the start address is obtained, and the corresponding character identifying signal extracted from the function control storage area, the start address is incremented and the process is repeated for the next character identifying signal, in sequence, until a stop code is detected. Thus, for example, FIG. 8 illustrates three reserved areas in the read only storage device 53 pointed to by start addresses for the "ceed", "cede", and "sede" word endings. Accordingly, each start address is a representation of the associated word ending.

Figure 7:
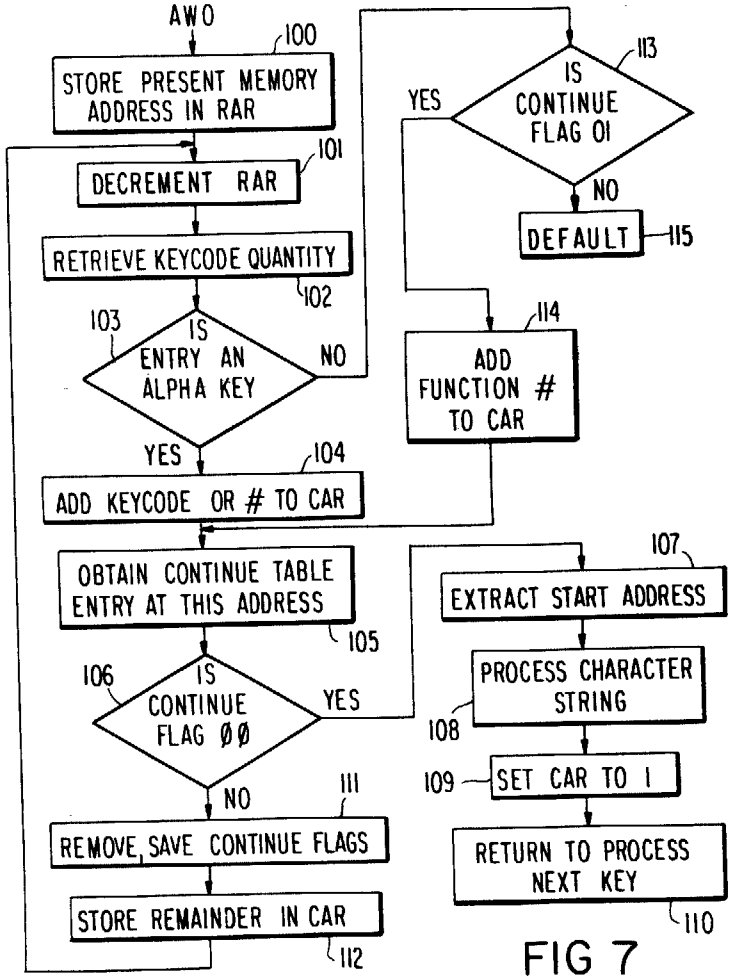
FIG. 7 illustrates the logic flow for the decision tree processing.

FIG. 7 is the processing routine executed by the processor 52 when automatic word ending operation is initiated on decoding of the keycode for an automatic word ending key actuation. As described above, this can be based on the unique keycode, i.e., for a single purpose key, such as the key 11, shown in FIG. 3A or the key 12 or 13, shown in FIG. 3B. On the other hand, automatic word ending operation can be initiated based upon decoding of a multi-purpose keycode, such as that of key 35 (FIG. 1) or one of keys 28, 29 and 30 (in FIG. 2), in the simultaneous presence of the automatic word ending mode.

Finally, automatic word ending can be initiated by decode of a multi-purpose key (i.e. key 35) coupled with the condition that a previous key entry was a character (or one of a set of specific characters).

If, for example, a multipurpose key (i.e., 28–30 or 35) is employed without use of any mode changing key such as key 38 and no allowable word ending is found the text recorder is allowed to output the character/-function associated with the multi-purpose key (i.e., 28–30 or 35) which is not an automatic word ending function. See the discussion of response to defaults, infra.

Regardless of the manner in which entry into automatic word ending operation is initiated, the first function, function 100, stores the present memory address (contained in MAR) in the RAR. The present memory address is the address in the keycode storage, at which the keycode corresponding to the automatic word ending key actuation is stored. Function 101 then decrements the quantity in RAR, thus, RAR points to the keycode stored prior to actuation of the automatic word ending operation. Function 102 then retrieves the code quantity from the keycode storage area in R/W storage device 51. Function 103 then tests the entry to determine if it is an alpha key. Assuming it is an alpha key, then function 104 adds the keycode or the corresponding unique quantity to the CAR. As will be seen hereinafter, the contents of CAR prior to performing forming function 104 was the quantity 1. Function 105 then employs the quantity in CAR as an address into read only storage device 53. Function 106 detects the continue flag combination. If the continue flag combination is 00, then function 107 is performed to extract the start address inasmuch as the desired word ending has been identified. Function 108 begins with the start address and outputs the character identifying signals by using the appropriate reserved area as shown, for example, in FIG. 8. Function 109 then sets the CAR to a quantity 1 and that concludes the processing as indicated by function 110, a return to process the next entry.

Function 108, in processing the desired word ending, can then fill the sequence of character identifying signals corresponding to the desired word ending into the keycode storage device 51 (more particularly into an output buffer **51*a*** therein) just as if the operator had actuated the corresponding keys.

The first character identifying signal is inserted into the space located by the Memory Address Register, (MAR) which is thereafter incremented. Each succeeding character identifying signal is similarly stored until the stop code is detected.

Assuming, however, that the continue flag was not 00, then further processing may be required. Therefore, function 111 removes and saves the continue flags for reasons which will be explained. Function 112 then replaces the old quantity in CAR with the quantity obtained from the continue table at the location addressed. Then the routine loops back to function 101 to decrement the RAR and continue processing.

If, at function 103, the entry pointed to by the RAR is not an alpha key, then test 113 determines the status of the saved continue flag, saved at function 111. If the continue flag had been 01, indicating that processing was continuing, the unique keycode associated quantity is summed to the contents of the CAR at function 114 to develop a pointer to a further table. A short example will suffice. Consider the words accede and ostracize. Each word ending is preceded by "ac", however the word endings can be differentiated by examining the keycode preceding the "ac" combination. If a space, then word ending cede is appropriate, if an "r" then the ize ending is appropriate. In the first case the continue table entry pointed to by the sum of "a" pointer and space function code would identify the the cede word ending. In the second case the sum of "a" pointer and the "r" code would point to the ize ending. In the absence of an 01 flag combination, detection of a non-alpha keycode indicates a default at test 113.

The routine continues at function 105 and obtains the new continue table entry at the address corresponding to the contents of the CAR.

If at any time the continue flags saved at function 111 correspond to 11 (indicating a default), on the next or a succeeding pass through the routine at which a non-alpha keycode is found, at test 113, it will be determined that the continue flag is not 01, and therefore, a default will be noted, at function 115. Alternatively, a second test can be used on the no branch of function 106, to test for a default condition.

Depending upon other constraints, the default can be handled in one of a number of ways. It may, for example, simply result in no operation indicating to the operator that, for some reason, the test recorder is incapable of automatically completing the word, and therefore, requires the operator to do so in a conventional fashion. In other circumstances, where for example, the key which actuated the automatic word ending operation is a dual purpose key it may merely indicate that automatic word ending is not appropriate and another function associated with that key should be employed or a character associated with that key should be displayed in lieu of a word ending.

Based on the foregoing explanation, we can now describe operation of an automatic word ending text recorder, operating with a keyboard of the type shown in FIG. 3B. For this example, we assume that the operator has previously keyed in several characters and now wishes an automatic word ending to be selected corresponding to that associated with the key 12, and therefore, key 12 is actuated.

When the key 12 is actuated, the keycode is generated in the keyboard interface 1, and coupled through the data lines to the processor 52. Processor 52 determines that the key 12 is an automatic word ending key by any conventional decoding steps. Upon recognizing actuation of the automatic word ending key 12, the program steps of FIG. 7 are initiated. After processing one or more previous key entries as outlined above, a continue table entry is read which has the 00 flags indicating that the associated quantity is a start address. This address is passed to the character processing routine of the type shown in FIG. 9, in the above-referenced application. Briefly, this routine merely retrieves the character identifying signals stored either directly or indirectly at the addressed location and increments the addressed location and continues retrieving character identifying signals until a stop code is detected. In this connection it should be noted that it may be desirable to include a space function at the conclusion of the last character and before the stop codes so that the automatic word ending text recorder will not only display the appropriate word ending, but also provide the space function between the word and the remaining text.

Operation of a keyboard such as that shown in FIG. 3A is identical except that the decision tree is amended to include the other possible word endings and correspondingly, the continue tables are supplemented with the necessary entries.

Operation of an automatic word ending text recorder with a keyboard such as that shown in FIG. 2, requires few additional modifications. Firstly, an automatic word ending mode latch must be added and controlled as is disclosed in the above-referenced application for the multicharacter mode latch. FIG. 4D illustrates an embodiment employing a processor 50' arranged for use with the keyboards of FIG. 1 or FIG. 2. Both FIGS. 1 and 2, by the presence of mode key 38, indicate that the text recorder can be in a conventional mode or an automatic word ending mode. Each time key 38 is depressed, the mode is changed so that two depressions of key 38 return the recorder to the original mode. FIG. 4D illustrates the presence of an automatic word ending mode latch AWE, which is responsive to actuation of key 38. As shown in FIG. 4D, mode latch AWE is physically located within processor 50' and is implemented as a flag register. Since the mode latch AWE has more than one stable state (in this case two), it is referred to as a latch. See in this regard the discussion of FIG. 8 and more particularly functions 101–103 in our prior application Ser. No. 107,467. Each of the keycodes for keys 28–30, when decoded in the presence of a set condition of the automatic word ending mode latch AWE, will result in actuation of the automatic word ending operation. That equipment is identical to that described in relation to the keyboard of FIG. 3B with the further exception that a different set of continue tables are provided for each of the keys 28–30. Finally, the operation of the keyboard such as that shown in FIG. 1 requires a continue table appropriate to the additional word endings, and the use of an automatic word ending mode latch so that when the keycode of key 35 is decoded in the presence of a set condition of an automatic word ending mode latch such as mode latch AWE, automatic word ending operation is initiated.

This first group of embodiments of the invention is employed with the retrieval address register (RAR) which is used to point sequentially to the previously entered keycodes corresponding to previously actuated keys in the reverse sequence in which those keycodes were first entered. A continue address register (CAR) is employed to point to one of a sequence of continue tables, and the entry in the continue table is selected based upon the identity of the previously entered character, the result of that entry is either a pointer to a next continue table or a word ending start address. The process repeatedly adds a unique quantity corresponding to a retrieved keycode to the continue table pointer to locate an entry in the table. This operation continues until either a default condition is determined or the start address of a word ending is located.

ALPHA SEQUENCE ID EMBODIMENTS

In another group of embodiments of the invention, a quantity is built up in an accumulator 152, termed the alpha sequence identification accumulator 152 or register abreviated alpha sequence ID which, when the automatic word ending operation is actuated, points directly to the start address of the associated word ending. To effect this, as each keycode is entered a unique quantity is added to the alpha sequence identification accumulator 152. Upon the occurrence of most numeric, function or symbol graphics, the alpha sequence identification accumulator 152 is cleared to zero and a new sum is accumulated on the next entry of a character key. So long as the different word endings are pointed to by a unique alpha sequence identification, the automatic word ending can be selected and output. In the event that an alpha sequence identification is provided which does not correspond to a start address of an automatic word ending, then a default condition is indicated.

Although the only constraint upon the numeric quantity assigned to the different keycodes to differentiate them is that they be unique, for purposes of the present example, we will assume that the keycodes for each of the 26 alphabetic characters comprises an ordered sequence from 1 to 26 wherein the quantity associated with character A is 1 and the quantity associated with the character Z is 26.

Table 1, reproduced below, compares the alpha sequence ID with the different word endings for the group of word endings comprising "sede", "ceed" and "cede". It will be seen that the alpha sequence ID 79 is the only one corresponding to "sede" and alpha sequence ID corresponding to "ceed" is 29, 49, or 43, and the other possible alpha sequence identification numbers 40, 4, 32, 66, 39, 23 and 24 all correspond to the word ending "ceed". The alpha sequence ID can be used directly to enter a table of start address pointers, or other conventional addressing techniques such as indirect and relative addressing techniques can also be employed.

TABLE I

| CHARACTERS ENTERED | | SUM | WORD ENDING |
|---|---|---|---|
| SUPER | | | SEDE |
| 19+21+16+5+18 | = | 79 | |
| EX | | | CEED |
| 5+24 | = | 29 | |
| PRO | | | CEED |
| 16+18+15 | = | 49 | |
| SUC | | | CEED |
| 19+21+3 | = | 43 | |
| ANTE | | | CEDE |
| 1+14+20+5 | = | 40 | |
| AC | | | CEDE |
| 1+3 | = | 4 | |
| CON | | | CEDE |
| 3+15+14 | = | 32 | |
| INTER | | | CEDE |
| 9+14+20+5+18 | = | 66 | |
| PRE | | | CEDE |
| 16+18+5 | = | 39 | |
| RE | | | CEDE |
| 18+5 | = | 23 | |
| SE | | | CEDE |
| 19+5 | = | 24 | |

Figure 9:
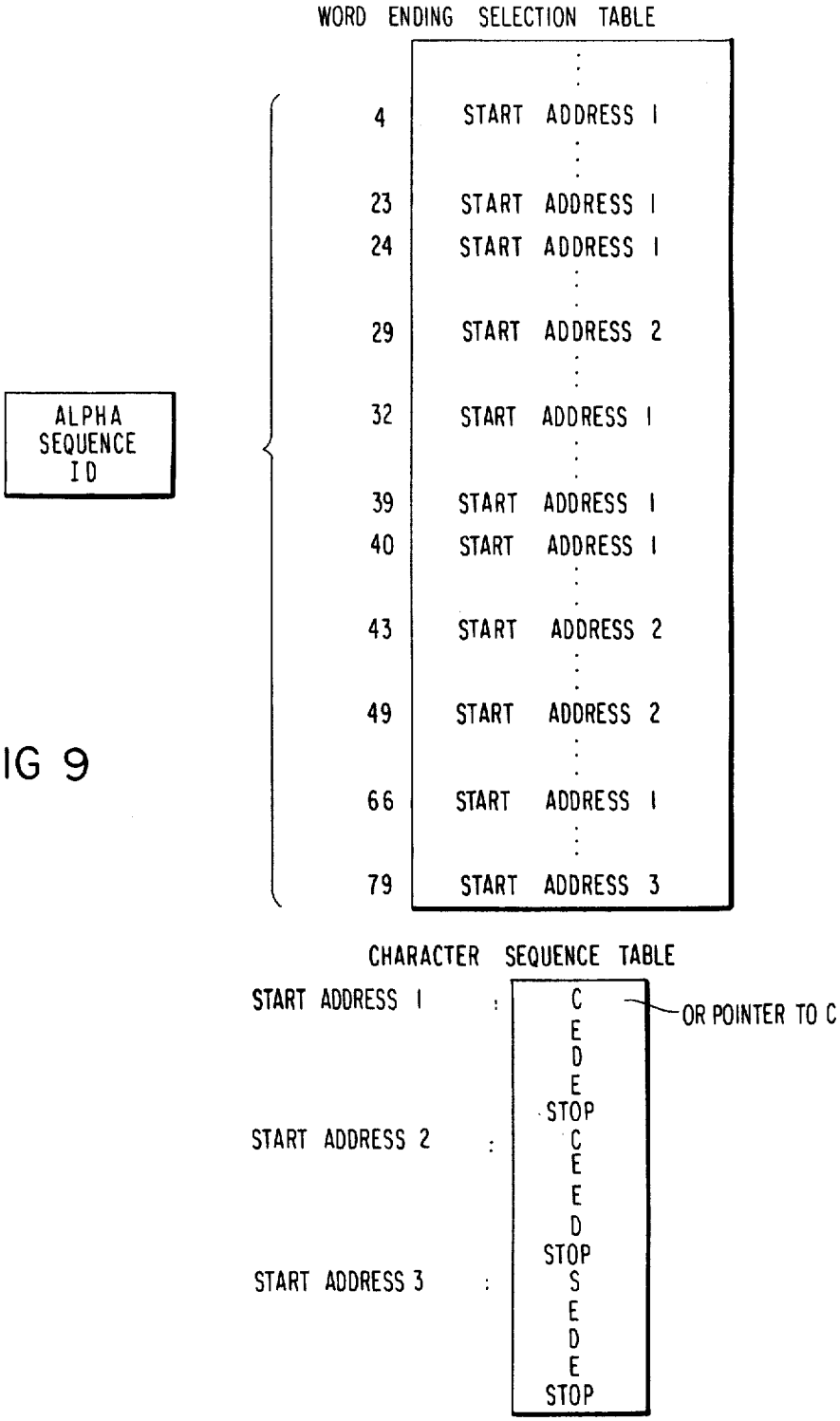

FIG. 9 illustrates the scheme employed. More particularly, when automatic word ending operation is initiated, the alpha sequence identification register contents are used as an address into the word ending selection table, to identify a number of start addresses which, in turn, refer to a character sequence table at which representations of a plurality of groups of word endings are provided, each group including a sequence of character representations in the sequence in which they are used in the word ending.

Since it can be foreseen that a hyphen may be an expected character in a word, it is important that entry of the punctuation graphic corresponding to a hyphen does not clear the alpha sequence identification register 152. To this end, the key entry processing includes a test for a hyphen key and, when such a key is detected, the alpha sequence identification register 152 is not cleared but the sum is maintained. Furthermore, detection of actuation of the hyphen key also protects the alpha sequence ID register 152 from being cleared by a subsequent carriage return function, for the same reason.

Figure 4B:
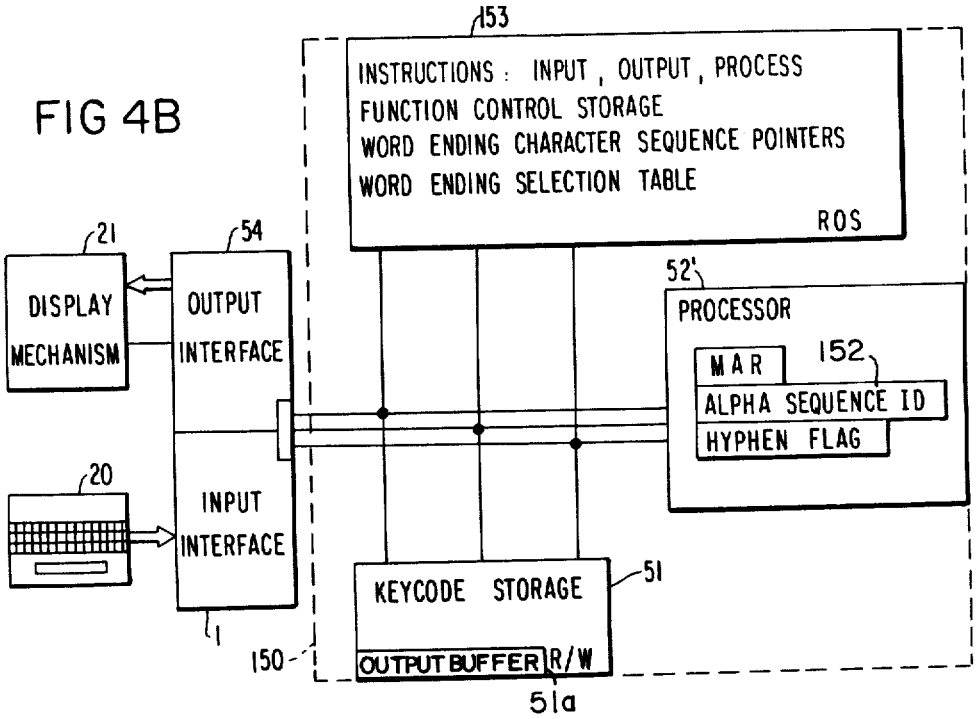
Figure 4D:
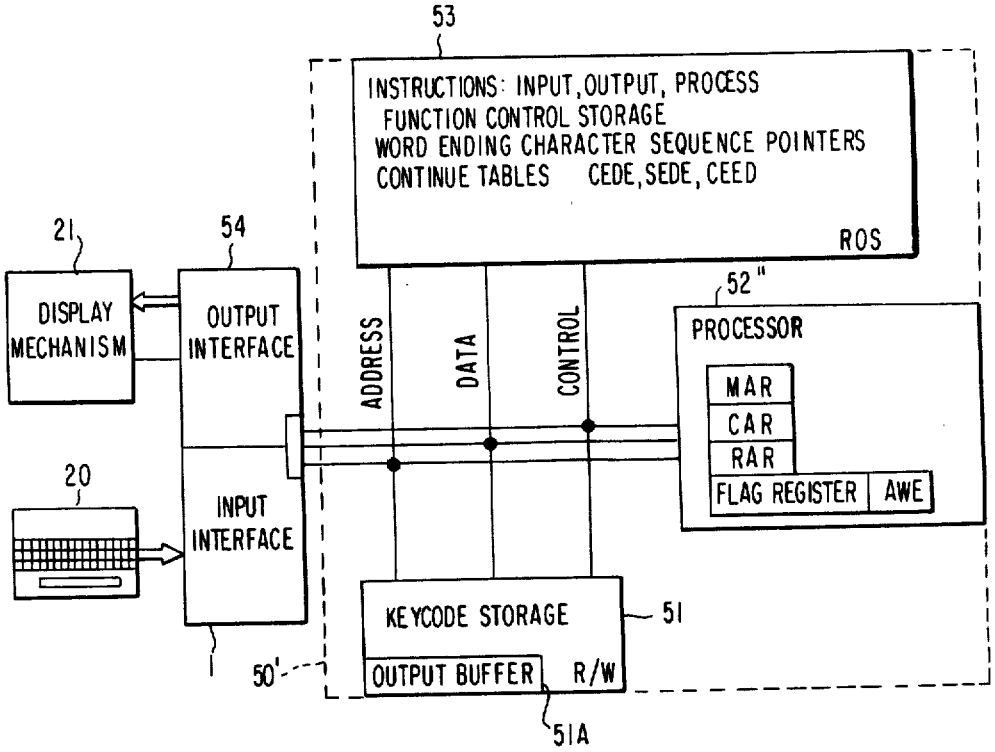

FIG. 4B is a block diagram of an embodiment of the invention, similar to 4A, including digital processor 150 (similar to digital processor 50) except that some of the tables in ROS device 53 and registers in processor 52' have been changed. The read only storage tables required for this operation are the sequence of character sequence tables, and the single word ending selection table. In the event that the alpha sequence quantity associated with each keycode is not the keycode itself or some quantity which is contained within the keycode, a further table may be required in the read only storage device 153 to translate keycode into alpha sequence identification quantities for summing in the alpha sequence identification register 152.

In the processor 52' itself, the RAR and CAR can be eliminated and instead an alpha sequence identification register (or alpha sequence ID 152) and hyphen flag are maintained. The processing routine is illustrated in FIG. 10.

Figure 10:
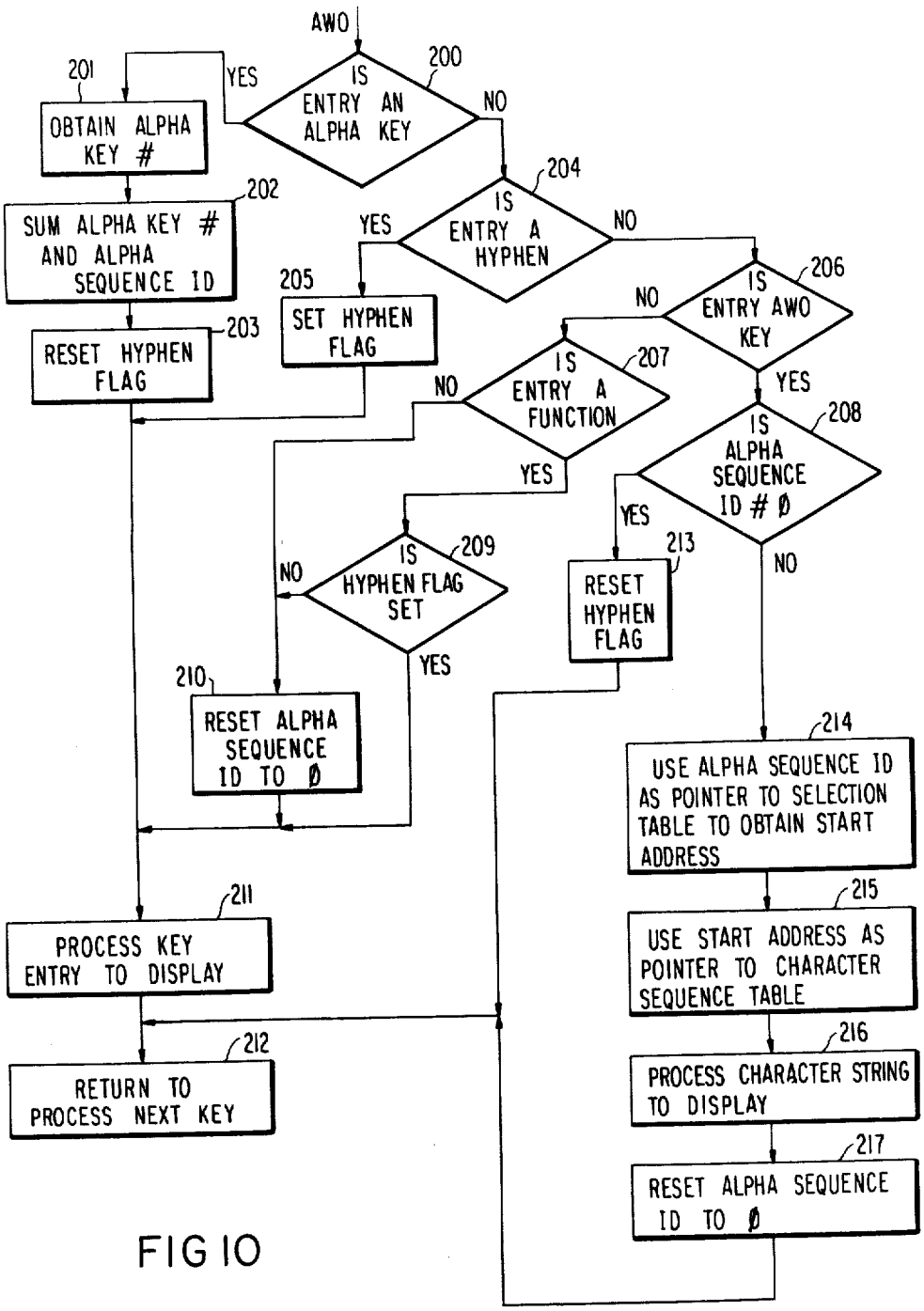
FIG. 10 illustrates the logic flow for processing associated with the alpha sequence register word ending selection.

In connection with the discussion of FIG. 10, we will describe an example in which an operator keys in the alpha sequence "ex" and then keys in an automatic word ending key. For example, in connection with the keyboard of FIG. 3B, that operation corresponds to actuation of keys 12 or 13. Similarly, in connection with the keyboard of FIG. 3A, actuation of key 11 initiates automatic word ending operation. Actuation of key 35 (FIG. 1) or keys 28–30 (FIG. 2) will initiate automatic word ending operation in the event the automatic word ending mode latch AWE is set by the previous actuation of key 38.

Proceeding with the example, when an operator actuates the "E" key, function 200 determines that the entry is an alpha key. Function 201 then obtains the alpha key number. As explained, this number might well be the keycode itself, or a quantity which is derivable from the keycode and either comprising a portion of the keycode or related to the keycode through the use of a table. In the example in disussion here, the alpha key number for this key is the quantity 5. Function 202 then sums the alpha key number with the prior alpha sequence ID. As will become clear hereinafter at this point in the processing, assuming the letter "E" is the first letter in the word, the alpha sequence ID would have been cleared to 0, and therefore after the summing operation of function 202, the alpha sequence ID would be 5. Function 203 resets the hyphen flag, the reason for which will become clear as this description proceeds. Function 211 then represents conventional key entry processing to display the character corresponding to the actuated key. When that has been concluded, function 212 returns to process the next key actuation.

In accordance with our example, the next key actuation is the "X" key, and the same processing is performed. As a result of function 202, the sum in the alpha sequence ID register 152 following that function is the sum 29, and at function 211, the corresponding character is displayed and at function 212, the process returns to await the next key actuation.

In accordance with our example, we assume that the operator now actuates a key initiating automatic word ending operation. Thus, function 200 determines the entry is not an alpha key. Function 204 determines that the entry is not a hyphen key. Function 206 determines that the entry is an automatic word ending key. Function 208 checks if the alpha sequence ID was 0, since in our example it is not, function 214 uses the alpha sequence as a pointer to a selection table to obtain a start address located in that table (see FIG. 9). Function 215 uses the start address as a pointer to a character sequence table (see FIG. 9) and function 216 processes the character string represented in the character sequence table beginning at the start address obtained at function 214. The processing necessary to display the character string is described in detail in the above-referenced application (in connection with FIG. 9). Function 217 then resets the alpha sequence ID to 0 and function 212 returns the process to respond to the next key actuation.

In order to illustrate the use of the hyphen tests, we can modify the example described above to assume that the operator keys in the sequence "EX-" and a carriage return before actuating the automatic word ending initiating key. The processing in response to actuation of the "E" and "X" keys proceeds in the manner explained above. Upon actuation of the hyphen key, function 200 determines that this entry is not an alpha key, but function 204 determines that the entry is a hyphen key. Accordingly, function 205 sets a hyphen flag and function 211 processes this key entry to display the hyphen.

The need for the hyphen flag comes about when a function key is executed, such as a carriage return, index or the like. To illlustrate the point, let us assume that the operator next initiates a carriage return. Function 200 determines that the entry is not an alpha key and function 204 determines that the entry is not a hyphen. Function 206 determines that the entry is not the automatic word ending operation key, and function 207 determines that the entry is indeed a function. Decision 209 determines that the hyphen flag is set, and therefore, the key entry is processed at function 211. Had the hyphen flag not been set, then function 210 would reset the alpha sequence ID to 0. Thus, setting of the hyphen flag prevents clearing of the alpha sequence ID in response to a function actuation. This serves to retain the alpha sequence ID sum so that the sum actually employed to access the word ending selection table is that related to all characters in the word prior to the word ending rather than only those characters on one line. Like function 203, function 213 resets the hyphen flag.

The preceding embodiments of the invention, i.e., those employing decision tree processing (those disclosed in connection with FIGS. 4A, and 5–8) and the embodiments of the invention employing the alpha sequence ID register 152 (disclosed in connection with FIGS. 4B and 9–10), carry storage requirements or processing requirements (for a given ensemble of word endings) which can be reduced by careful tailoring of the processing and the stored tables employed with the processing, by correlating the selections that must be made, and the information which is available to make those selections. The embodiment of the invention which will now be disclosed is a blend of the techniques from the previously disclosed embodiments, chosen so as to reduce the amount of storage tables required, and also to minimize the processing required in order to make an appropriate selection. Before disclosing the implementation of this embodiment, the basis upon which the tables and processing are based will be described.

We take as an example the selection to be made among the "sede", "shun", or "ize" sounding word endings based on preceding characters. Each of the "sede" and "ize" word endings include three distinct versions, and the "shun" sounding word ending includes two different versions, for a total of eight possible word endings. Appended hereto as Appendix A is a relatively complete list of word endings arranged by preceding character, i.e., the character prior to the word ending. Thus, from Appendix A it will be seen that the word endings following the alphabetic character "a" are only the "shun" endings, and of which the vast majority are "tion" ending, only four words in Appendix A have a preceding "a" character and the "sion" ending. Appendix A lists other possible word endings in order of the preceding alphabetic character.

One designator, to select among possible word endings is the alpha sequence ID. Thus, each alphabetic character (or the corresponding key code) is given a numerical weight, just as in one of the preceding embodiments of the invention. However, rather than employing an ordered weighting, the weightings listed in Table II is employed.

TABLE II

| ALPHA KEY | NUMERIC VALUE | ALPHA KEY | NUMERIC VALUE |
|---|---|---|---|
| A | 26 | N | 10 |
| B | 2 | O | 15 |
| C | 7 | P | 16 |
| D | 4 | Q | 17 |
| E | 1 | R | 18 |
| F | 6 | S | 19 |
| G | 3 | T | 20 |
| H | 8 | U | 21 |
| I | 9 | V | 22 |
| J | 14 | W | 23 |
| K | 11 | X | 24 |
| L | 12 | Y | 25 |
| M | 13 | Z | 5 |

Appendix A, in addition to identifying each immediately preceding character with one of the selected word endings, also lists the alpha sequence ID value for that word. Of course, the alpha sequence ID value is the sum of the weightings for each alphabetic character preceding the word ending. Thus, for example, the word "abrasion" has an alpha sequence ID value of 72, corresponding to 26 (a)+2 (b)+18 (r)+26 (a). While we have employed the particular weighting shown in Table II, those skilled in the art will understand that other weightings could similarly be employed with appropriate modification made to the tables which will be disclosed hereinafter.

An additional indicator, assisting in the designation of the appropriate word ending, is the alphabetic character immediately preceding the desired word ending. FIG. 11 is a frequency of occurrence table correlating the alphabetic character preceding the word ending with the associated or appropriate word ending or endings. FIG. 11 illustrates, for example, that certain of the alphabetic characters do not precede any of the allowable word endings (B-F-J-K-Q-Y-Z). While, on the other hand, certain alphabetic characters precede only one word ending (G-V-W-X).

Accordingly, the processing is simplified when automatic word ending is initiated by reviewing the identity of the immediately preceding alphabetic character using a character preceding table (CPT). If the alphabetic character is one of the first mentioned group, then the default selection can be immediately made because no amount of processing will produce an appropriate word ending. On the other hand, if the immediately preceding alphabetic character is one of the second mentioned group, then the appropriate word ending can be immediately determined from the identity of the preceding alphabetic character.

The remaining processing is employed to handle the situation when the immediately preceding alphabetic character is not in either of the two groups outlined above.

Those cases relate to word endings for the immediately preceding characters a,c,d,e,h,i,l,m,n,o,p,r,s,t, and u.

At this level of processing, the processor 252 has identified the immediately preceding alphabetic character and also has available to it, from the alpha sequence ID register 152, the word value of all of the characters in the word preceding the desired word ending. Thus, assuming that the processing has determined that the immediately preceding character is not one of either of the two groups mentioned above, then an alpha table is selected based upon the immediately preceding character. Entering the selected table at a location determined by the alpha sequence ID will, in most cases, identify the desired word ending. The necessary string of character and function identifying signals can be produced using techniques described in connection with other embodiments of this application from a single address which is determined from the table.

In some cases, however, conflicts exist in that certain words, having identical alpha sequence ID quantities and identical characters preceding the word ending, actually employ different word endings, and thus additional information is required in order to make the desired selection. Table III lists these conflict situations for the words and endings of Appendix A.

TABLE III

| | ALPHA SEQUENCE ID |
|---|---|
| A-TION | |
| cancellation | 101 |
| computation | 101 |
| identification | 101 |
| modernization | 101 |
| toxication | 101 |
| variation | 101 |
| persuasion | 101 |
| designation | 72 |
| gyration | 72 |
| abrasion | 72 |
| obligation | 67 |
| invasion | 67 |
| C-TION | |
| induction | 51 |
| exercise | 51 |
| action | 33 |
| accede | 33 |
| N-IZE | |
| reorganize | 91 |
| intervention | 91 |
| mechanize | 65 |
| convention | 65 |
| S-SION | |
| submission | 83 |
| emphasize | 83 |
| confession | 58 |
| question | 58 |

Consider, for example, "variation" and "persuasion". Each has the alpha sequence ID 101 and the alphabetic character "a" preceding the word ending, but of course, the first has the "tion" ending and the second has "sion" ending.

Accordingly, additional processing is required to resolve these conflicts. Obviously, in this conflict situation, the information concerning the alphabetic character preceding the word ending, and the alpha sequence ID associated with the word is simply inadequate to make the desired selection. Therefore, in these specific situations, additional tables are required, based on these specific words, and employing information concerning one or more of the characters preceding the characters immediately preceding the automatic word ending, to make the desired selection.

This additional table (exception table) includes one entry for each conflict situation. The alpha table, which identifies a conflict also points to the entry in the exception table which can resolve the conflict. Each entry in the exception table includes a pointer for each of the word endings making up the conflict and a data item with which to resolve the conflict. Preferably the data item will be a selected character in a word with one ending but not appearing in the word with the other ending. For example, consider the words "persuasion" and "variation". Each has a different word ending, but each word has the identical character (a) preceding the word ending. Furthermore, each word had the alpha sequence ID of 101—thus a conflict. Since both words have the same character preceding the word ending and both have the identical weight, some other distinguishing characteristic is required. In the embodiment to be disclosed the distinguishing data item is the first character "p" in persuasion but not "p" in "variation". Thus, the exception table data item can be compared with the first character of the word selected by the operator. This character is stored in a first entry register, in a manner to be explained. If comparison of the first entry register contents and the exception table data item gives one result (favorable or unfavorable) then one word ending is selected and vice versa. There is no requirement that the data item correspond to the first character although that is preferred for simplicity purposes. Indeed, the data item can be any item capable of distinguishing the conflict words. For example, rather than the first character, it might be the first character pair, or other character combination. However, the data item need not even be related to the identity of one or more characters preceding the word ending for it might be the number of characters preceding the word ending.

Within the example indicated, the processing steps and tables are adequate to make the desired selection in every case, except one. The words "action" and "accede" have the identical prefix "ac". Accordingly, no amount of processing can select the appropriate word endings since there is simply inadequate information to make the selection. Two alternatives are available; the first alternative is to merely indicate to the operator that this is a default condition and automatic word ending is simply impossible, thus requiring the operator to key in the appropriate word ending; on the other hand, by appropriately modifying the processing tables disclosed herein, the automatic word ending could be semi-automatically produced by requiring the operator to select the first character of the word ending (that is, the "t" for action and "c" for accede), or by insuring that the initiation of automatic word ending operation distinguish between the "shun" and "sede" word endings.

Thus, in accordance with this embodiment of the invention, as the operator keys in alphabetic characters in a word, identification of the characters (according to the keycode or similar unique character designation) is stored in the order in which it is entered (and in accordance with conventional techniques the corresponding character is displayed or printed). At the same time, the first entry register FER is loaded with first character information and an alpha sequence ID register 152 accumulates a quantity corresponding to the alphabetic character weightings in accordance with that shown in Table II, for example. When an automatic word ending operation is initiated, for example, by depression of a single or multi-purpose key under the appropriate circumstances, the processing, based on the preceding alphabetic character, refers to a character preceding table (CPT). The CPT table has three different types of entries. A first type of entry in the CPT table is a default entry associated with each alphabetic character which does not have an allowed automatic word ending in the dictionary of automatic word endings; a second type of entry in the CPT table is a start address, i.e., an address at which is stored a pointer designating (or representing) a particular one of the available word endings, and the third type of entry is a pointer to an alpha table associated with the preceding alphabetic character. When the preceding alphabetic character points to either the first or second type of entry in the CPT table, the processing is, in effect, concluded, since a selection has already been effected that no allowable word ending exists, or of the appropriate word ending. Only when the entry in the CPT table is to another table must substantive processing continue.

Each pointer in the CPT table which points to another table points to one of a number of alpha entry address tables.

Each alpha entry address table is firstly associated with a different one of the possible alphabetic characters immediately preceding automatic word endings, and each alpha entry address table includes plural multi-word entries. Each entry includes a quantity corresponding to the alpha sequence ID for an associated word, an address pointer which points either to a representation of a selected word ending (i.e. a start address) or a pointer to a further table, the exception table. When processing employs one of the alpha entry tables the logic increments through the alpha entry table, starting at the beginning of the alpha entry table, looking for an equal comparison between the alpha sequence ID contained in the alpha sequence ID register 152, and the entry in the alpha entry table. One of the two flags in each entry is the "last compare flag" which indicates that if a comparison is not effected, then the last entry in the alpha entry table is the pointer to the associated word ending.

When a comparison is effected between the quantity in the alpha sequence ID register 152 and the quantity in the alpha table entry, then the further flag is checked, the exception flag. The exception flag identifies those conflict situations which are illustrated in Table III. When an exception flag is on, further processing is required with reference to an exception table, and the alpha entry table provides a pointer to the exception table. Each entry in the exception table corresponds to a different one of the exceptions of Table III. If the last compare flag is set then by comparing the data item in the appropriate exception table entry with the contents of the first entry register FER (of processor 252) the processor 252 can determine which of the word endings associated with the entry is appropriate. Additional processing is required if there is more than two word endings to select from in an exception group. In particular, the processor 252 must increment through an entry in the exception table to determine an appropriate word ending by comparing the exception table data item and the contents of the first entry register FER. Once such a determination is made the corresponding character signals are extracted using the proper pointer also included in the exception table entry.

FIG. 4C is a block diagram of the apparatus employed in this embodiment of the invention. Reference to FIG. 4C illustrates that it is similar in format to FIGS. 4A and 4B and includes digital processor 250 (which is similar to the digital processor 50) but that some of the tables in the read only storage device 253 have been altered as compared to FIGS. 4A and 4B, and that the processor 252 includes several registers and other hardware devices specific to this embodiment. Before describing the processing logic employed, the several tables contained in the read only storage device 253 are described.

FIG. 12 illustrates the Character Preceding Table (CPT). The CPT table has 26 entries, one corresponding to each alphabetic character. Outside the CPT table, under the column headed "Numeric Code Address" are three columns: a first column indicating the relative address of each entry, relative to the base address (K), the second column indicating the absolute address of each entry, and the third column indicating the preceding character whose detection leads to entry to the CPT table. Inside the CPT table, the phrase describes the meaning of each entry, while the numeric quantity in parenthesis is one example of what the CPT table could actually contain. For example, the first entry corresponds to an alpha table pointer for the E alpha table and this pointer actually comprises a numeric quantity 41. Similar pointers are included for the characters D,C,H,I,N,L,M,O,P,R,S,T,U and A. Reference to FIG. 11 indicates that it is exactly these characters which are the preceding character to at least two different word endings, and therefore, the read only storage 253 includes an alpha entry table for each character. The second type of entry in the CPT table is a start address, and start addresses are provided corresponding to the preceding characters G,V,W,X, respectively. Reference to FIG. 11 indicates that it is just these characters which are the preceding characters to only a single word ending. Accordingly, the corresponding CPT entry provides a pointer to the start address location for these different word endings, and thus each start address is a representation of the associated word ending. Finally, a third type of entry in the CPT table is a default entry, and default entries are provided corresponding to the character preceding a word ending for the characters B,Z,F,K,J,Q, and Y. Reference again to FIG. 11 indicates that it is just these characters which do not precede any word ending in the ensemble of word endings which can be automatically provided by the equipment. The default entry can comprise any type of entry which the processor 252 will recognize as signaling a default, for example, a numeric quantity of zero can be employed, alternatively various flags could be employed.

FIGS. 13A through 13D illustrate respectively the format for each entry in the alpha table, as well as each alpha table employed. Referring first to FIG. 13A; an entry usually comprises two words, the first word corresponding to the alpha sequence ID, and a second word made up of two flags, a last compare flag and an exception flag, and an address pointer. Each alpha table may include a plurality of entries, one for each different word having a character preceding the word ending identical to the character which is associated with the alpha table. The address pointer portion of the entry is a start address pointer, if no conflicts exist (a conflict is defined as a situation in which the alpha sequence ID and the character preceding a word ending are identical for two different word endings). In the event that a conflict situation exists, then the address pointer, rather than representing a specific word ending, points to a location in an exception table which is employed to resolve the conflict. When the address points to an exception table, the exception flag is set, otherwise it is not. The next to last entry in each alpha table has the last compare flag set, otherwise the last compare flag is not set. This is employed in processing through an alpha table to indicate that when the last compare flag is found set, the next entry processed is the last entry in the alpha table. This feature enables a large reduction in the extent of the alpha table, as will be described. The last entry in each alpha table omits the alpha sequence ID word, and the flag bits may be ignored.

Referring now to FIG. 13B, the alpha tables for the preceding characters "A", "D", "E", "H", and "C" are illustrated. Referring to the A alpha table, the word of the first entry is an alpha sequence ID of 101. Note that the exception flag is set for this entry indicating a conflict. Thus, the numerical quantity occupying the address pointer location can be employed as an entry into the exception table so as to resolve the conflict. Referring back to Table III, it will be noted that the alpha sequence ID of 101 is identical for words with the character preceding the word ending "A" for either the "tion" or "sion" word endings. Thus, the conflict must be resolved by further processing. On the other hand, the first memory word of the second entry in the alpha table for "A" has an alpha sequence ID 55 and an exception flag which is not set. Thus, the numerical quantity in the address pointer location for this entry is a pointer to the "sion" word ending, and indeed, actually represents that particular ending. We can refer to Appendix A, for example, to verify that the alpha sequence ID 55 corresponds to the word occasion.

Referring to the next entry in the alpha table, note that the exception flag is again set. The alpha sequence ID 67 corresponds, according to Table III to either the words obligation or invasion, and the pointer "6" can be used to address the exception table to enable resolution of the conflict.

The next to last entry in the alpha table has an alpha sequence ID value 72, and the exception flag is again set. Referring to Table III, we see that the value 72 can correspond to either the "tion" or the "sion" ending, and therefore, the pointer "3" provides a reference to the exception table to resolve this conflict. Note that this next to last entry includes the last compare flag set also. Accordingly, the next entry in the alpha table is but a single word long, i.e., it does not have alpha sequence ID; it merely has a representation to a specific word ending. This illustrates an important advantage of this type of table. FIG. 11 indicates that word endings preceded by the alphabetical character "A" are either "sion" or "tion", four words falling into the first and 156 words falling into the second. The alpha table illustrated in FIG. 13B calls out each of the potential conflicts, i.e., alpha sequence ID values of 101, 67 and 72 as a specific entry, one entry for the one unambiguous "sion" word ending, and then rather than having an entry for each of the other 153 "tion" endings, a single entry suffices inasmuch as each of those words have the identical "tion" ending.

This is clearly illustrated in connection with the "L" alpha table, shown in FIG. 13C. Reference to FIG. 11 indicates that there are 49 different words in which the character preceding the word ending is "l", two of those employ the "yze" ending and the rest employ the "ize" ending. The "L" alpha table has but three entries, two corresponding to the two specific "yze" endings, and a third handling all of the 47 "ize" endings. From the foregoing the contents and creation of each of the other alpha tables is believed apparent and therefore no further discussion is provided.

FIGS. 14A and 14B illustrate respectively, the format for a typical entry in the exception table and the exception table itself. A first word includes a pair of flags, the last compare flag and the exception flag, and an alpha numerical value corresponding to the first character of one of the two words having the different endings. The different endings are represented by the pointers in the second and third words of each entry. Thus, for example, the first entry in the Exception Table has a numerical value 16 in the first word corresponding to the alphabetic character P. The first of the two pointers associated with this entry is a pointer to the word ending "sion". Thus, when this entry of the exception table is accessed, the numerical quantity in the first word of the exception table is compared to the first entry register (which is loaded in a manner to be explained hereinafter). If the comparison indicates they are identical, then the first pointer employed, if the comparison does not indicate a comparison, the second pointer is employed. Each of the other entries in the Exception Table are similar except for the entry corresponding to preceding character with the ID value 33. It has already been noted that the word ending for the words "action" or "accede" cannot be determined by reference to the characters preceding the word ending, since they are identical (both use the preceding characters "ac"). Thus, this particular entry includes a set exception flag, and may also include a default entry rather than a pointer, to indicate that the exception condition cannot be resolved. While each example in the Exception Table (FIG. 14B) has only two word endings to choose from, it is conceivable that a conflict may exist between more than two possible word endings. In that case the Exception Table entry would include a pointer for each member word ending of the group and enough data items for comparison to allow the appropriate ending to be identified.

FIG. 15 illustrates the word ending Output Table. The output table includes an entry for each different word ending. The output table shown in FIG. 15 includes accessible addresses (relative to a base address) of 227 (for the word ending "sede"), 231 (for the word ending "cede"), 235 (for the word ending "ceed"), 239 (for the word ending "yze"), 242 (for the word ending "ise"), 245 (for the word ending "ize"), 248 (for the word ending "sion"), and 252 (for the word ending "tion"). When a start address is passed, each associated pointer is extracted, and used as a pointer into the function control storage at which was stored the character representing signals. Alternatively, the character representing signals could be stored in the word ending output table, if desired. The additional bit, stop bit equals one, is stored with each pointer to the last character of a word ending to indicate to the processor 252 that the word ending is complete. Optionally, the word ending can conclude with a space (or space pointer) following the last character and accordingly, the stop code is associated with the space (or pointer).

Figure 16A:
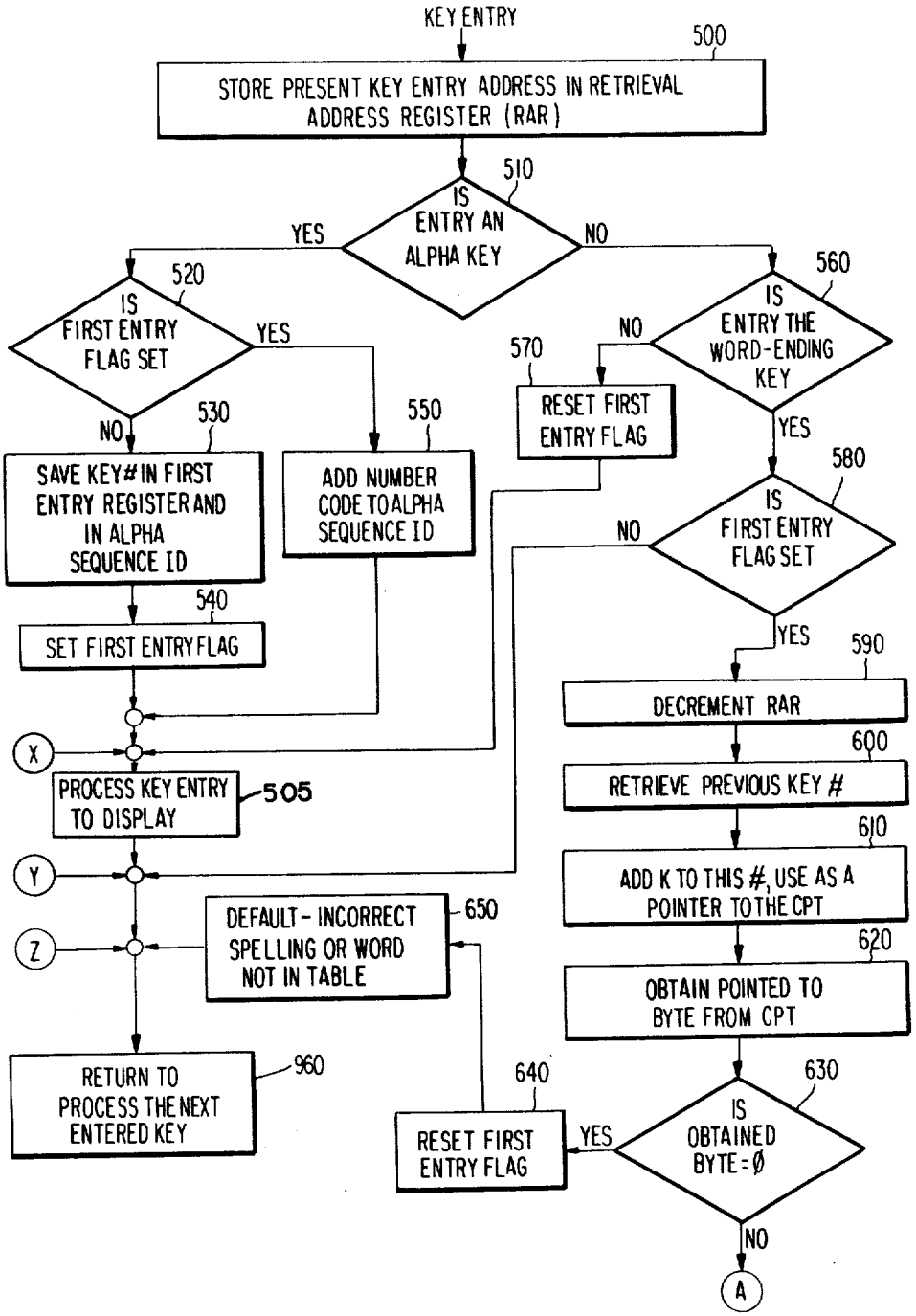
FIGS. 16A–C illustrate the logic flow appropriate to the third embodiment.
Figure 16B:
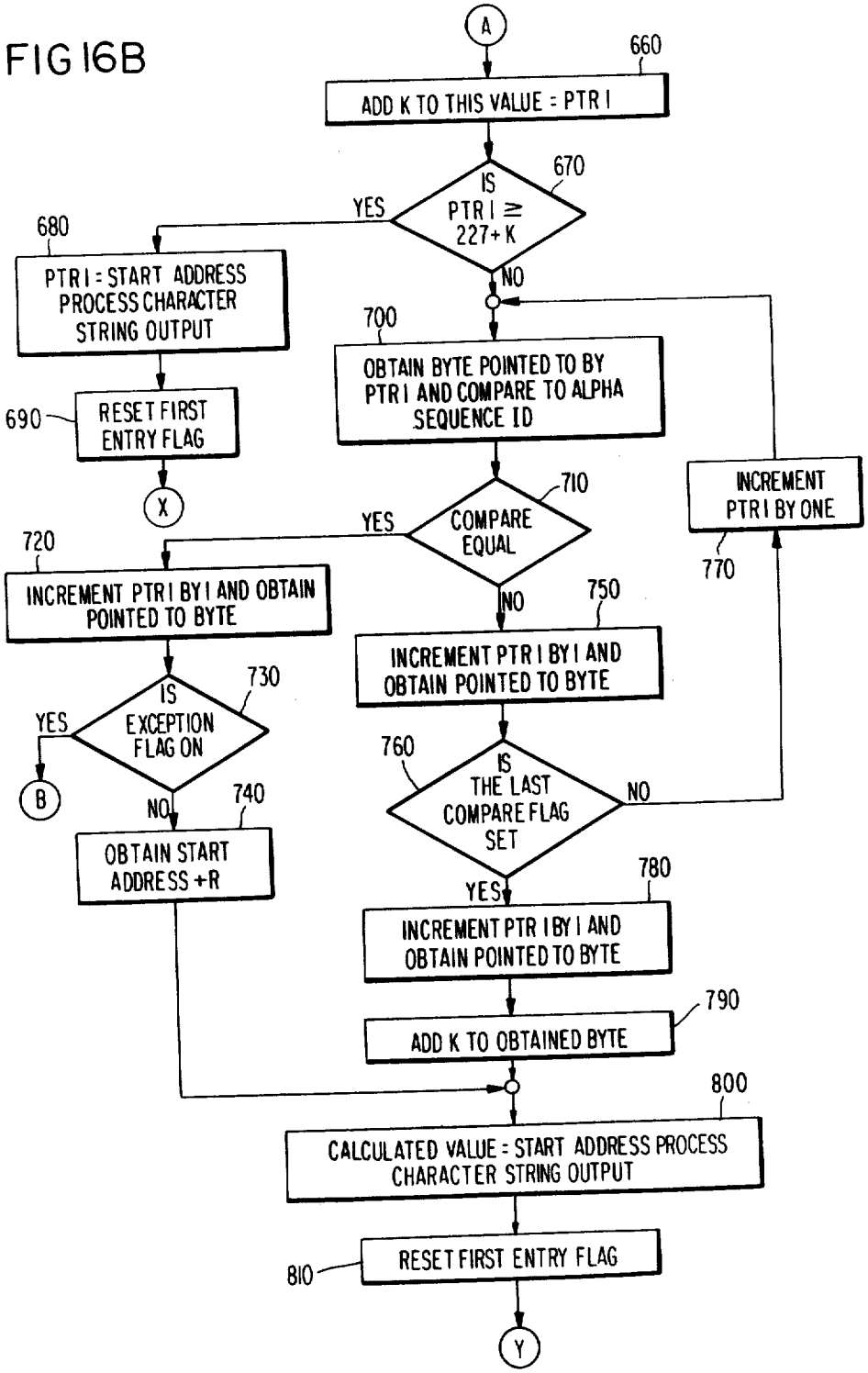
Figure 16C:
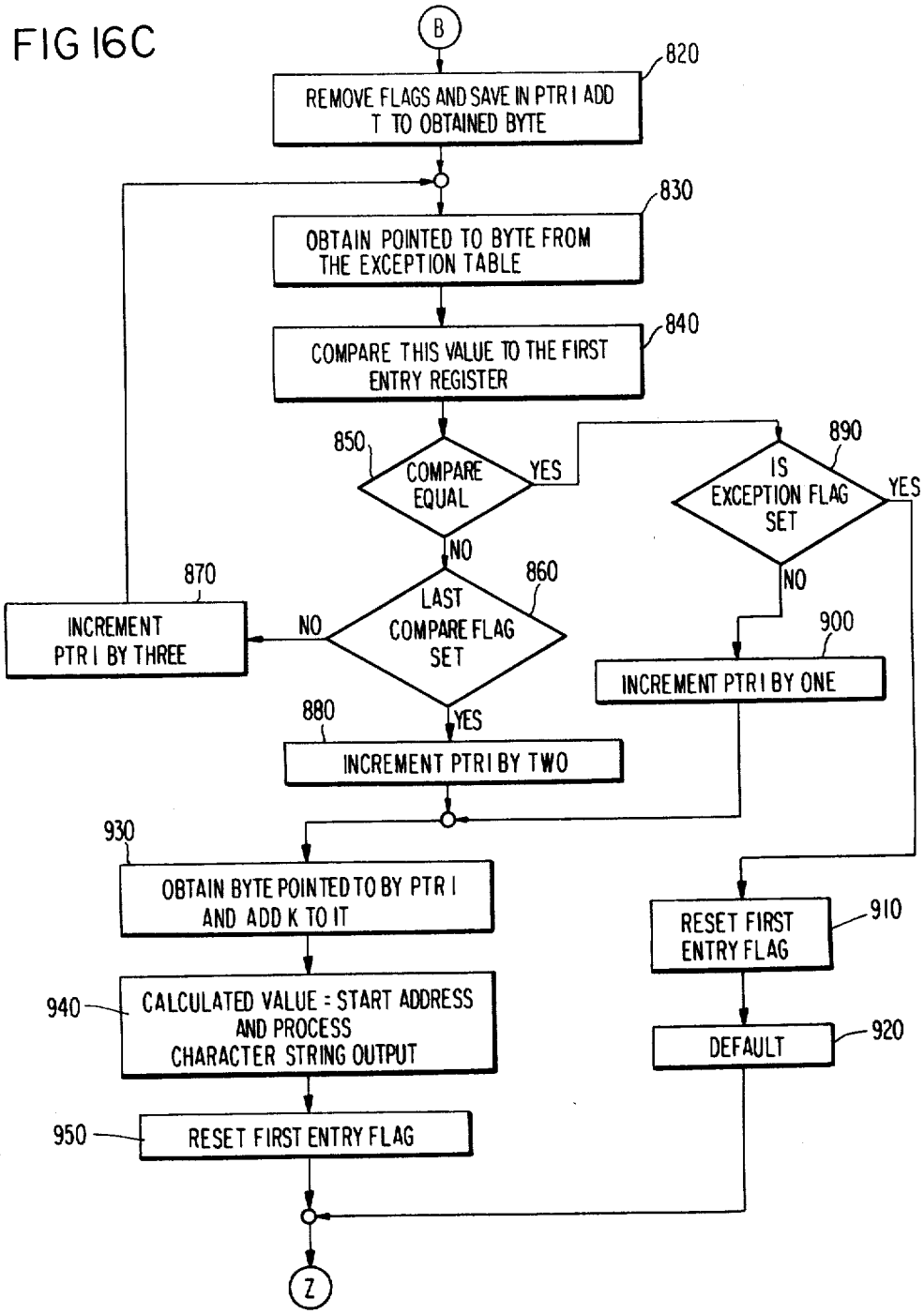

Finally, FIGS. 16A through C illustrates the processing carried out by the processor 252 in connection with this embodiment of the invention.

When the processor 252 recognizes an actuated key, function 500 stores, in RAR, the address at which the keycode is stored. Function 510 then determines whether or not the entry is an alphabetic character key. The manner in which this is accomplished has been discussed above. Assuming it is an alphabetic key, function 520 determines if the first entry flag is set (the first entry flag is a flag maintained in the processor 252); this function is accomplished by merely noting the condition of the flag. As will become clear, this flag is set until it becomes reset by the keying of a space, other function or most other symbol graphics. The use of a hyphen flag, to prevent clearing of the alpha sequence ID register 152 on actuation of carriage return after hyphen actuation is illustrated in connection with FIG. 10 and is not repeated here. Clearly, the same function and hardware could be used in connection with the embodiment of the invention, not only to prevent clearing of the alpha sequence ID register 152, but the first entry register as well. Assuming the first entry flag is not set, function 530 clears the alpha sequence ID register 152 and stores the numerical quantity associated with a key (shown for example in Table II) in the first entry register and also places the identical quantity in the alpha sequence ID register 152 which, as will become clear hereafter, had previously been cleared. Function 540 then sets the first entry flag. That concludes the processing for this key entry, which is pertinent to the invention. The remaining processing (represented at function 505), in order to effect display of the key character, is not disclosed herein. Thereafter function 960 effects a return to process the next key entry.

On the next and each succeeding actuation of a character key, function 520 determines that the first entry flag is set and accordingly, functions 530 and 540 are skipped, and instead, function 550 is performed.

In the course of operation the operator may actuate a key which is neither an alpha key nor the key which initiates automatic word ending operation, such a key might be, for example, a space bar 39, carriage return CR, etc. Under those circumstances functions 510 and 560 determine that the actuated key was neither an alpha key nor the automatic word ending key. Accordingly, function 570 merely resets the first entry flag.

Assume now that the operator has keyed in everything but the word ending, and now desires the word to be automatically completed. The operator therefore actuates the key which initiates automatic word ending operation. Accordingly, function 510 determines that the actuated key is not an alpha key, but function 560 determines that the key actuated is the automatic word ending key. Function 580 checks to see if the first entry flag is set. It is noted that if the flag is not set, the processing terminates. However, in our example, the first entry flag had remained set and therefore, function 590 is performed to decrement the RAR. Since the RAR previously addressed the location at which the automatic word ending operation keycode was stored, decrementing the RAR enables it to point to the location immediately preceding the location storing the automatic word operation keycode. This location stores the keycode of the character initiated immediately prior to word ending operation. Function 600 retrieves this keycode and function 610 adds a base value K and uses the resulting sum as a pointer into the CPT table. Function 620 obtains the addressed byte from the CPT table. Reference to FIG. 12 indicates that this byte comprises either a default entry, pointer to an alpha table or a pointer to a start address. Function 630 determines if the byte corresponds to a default. If it does, functions 640 and 650 are performed to respectively reset the first entry flag and signal a default. However, assuming that a default is not located then, as shown in FIG. 16B, a base address value (in this case K) is added to the pointer and the results are stored in register PTR1 (function 660).

Function 670 determines whether or not the quantity in PTR1 corresponds to an alpha table pointer or a start address. By prearrangement all start addresses are located in one memory area, and all alpha tables are stored in a different memory area. Accordingly, simply comparing the calculated address with the lowest address for start addresses, for example, reveals whether a start address or alpha table is addressed. Obviously, other techniques could be employed to determine whether or not the byte extracted from the CPT table was an alpha table pointer or a start address. For example, a flag could be used to make this determination. In any event, assuming that the byte corresponds to a start address, then function 680 loads the start address in register PTR1 and processes the character output string. Reference to FIG. 15 illustrates that the character output string is located sequentially beginning at the start address, and therefore, as each character or character pointer is extracted, the quantity in register PTR1 is incremented and the process is repeated until a stop code is detected. When the character string has been output, function 690 resets the first entry flag. Thereafter processing skips, via X to function 960 (see FIG. 16A).

Assuming however, that a start address was not immediately located from the CPT table, then function 700 is performed. Function 700 obtains the byte pointed to in the associated alpha table, and compares this byte with the contents of the alpha sequence ID register 152. Function 710 determines whether or not the comparison indicates an equality. Assuming equality is not indicated, the function 750 increments register PTR1 and obtains the next byte in the alpha table. Function 760 determines if the last compare flag was set, and assuming it was not, function 770 again increments register PTR1. The loop of function 700 through 770 is performed and a comparison made between the contents of the alpha sequence ID register 152 and the corresponding byte in the alpha table until either comparison is effected or function 760 indicates that the last compare flag is set (in processor 252). Accordingly, the processor 252 proceeds through the alpha table looking for one of these two conditions.

Assuming that at some point in this process the alpha sequence ID value from the alpha table is equal to the contents of the alpha sequence ID register 152, function 720 is performed to further increment register PTR1 and address the next byte. Reference to the alpha table indicates that the byte following the alpha sequence ID value in the alpha table is a pointer, and this incrementing action function 720 obtains that pointer. Since the pointer may point to either an exception table or a start address, function 730 checks the exception flag. Assuming the exception flag is not set, then function 740 uses the byte obtained from the alpha table as a pointer and develops an address by adding a base value (R). Note that this base value (R) is different from the previously used value (K). The tables and addresses employed herein have been adapted for 8 bit words, and most of the alpha table pointers employ only 6 bits, since two bits are set aside for flags. Clearly, if bit capacity was not important, the pointers could all use an identical bit count and therefore the base values could be identical (or dispensed with).

In any event, functions 800 and 810 are preformed, which are in all respects similar to functions 680 and 690 and result in production of the desired character string. Following function 810 processing skips, via Y to function 960 (see FIG. 16A).

On the other hand, the processor 252 may proceed entirely through the alpha table up to the next to last entry without finding equality between the contents of the alpha sequence ID register 152 and the corresponding alpha sequence value in the alpha table. If this is the case, function 760, at the next to last entry, indicates the last compare flag is set. Function 780 then increments register PTR1 and obtains the byte pointed to. As explained in connection with FIGS. 13B through D, this byte is a start address for a particular word ending. Function 790 adds K to obtain a start address, just as function 660 does. Accordingly, functions 800 and 810 et seq. are performed to output the character string.

In the event that the exception flag was detected as on, at function 730, then function 820 (see FIG. 16C) is performed which employs that byte as a pointer and develop an address by adding a constant (T) to the byte, after the flags have been removed. This address is stored in register PTR1. As mentioned in connection with FIGS. 13B-D and 14A-B, this byte now points to an entry in the exception table. Function 830 obtains that byte and function 840 compares the byte to the value in the first entry register. This byte is the additional data unit employed in the exception tables to make a selection between one of two appropriate word endings, and the selection is made by comparing the byte with the contents of the first entry register, which corresponds to the first character of the word. Depending on whether or not the comparison is equal (detected at function 850), the pointer in register PTR1 is either incremented by one or by two if the last compare flag is set (detected at function 860). (Functions 900 and 880). However, first function 890 checks to see if the exception flag is set. The exception flag, in connection with the exception table identifies an unresolvable conflict. If the exception flag is set, functions 910 and 920 reset the first entry flag and indicate the default condition. Assuming that the exception flag is not set, then function 930 obtains the byte pointed to by register PTR1, and adds the base address (K) to it. If the comparison, at function 850 did not indicate equality, and the last compare flag was not set (detected at function 860), then instead of incrementing register PTR1 by one it is incremented by three (function 870). This allows for more than two ending conflict groups to be searched for a comparison at function 850. In any event, once function 930 is performed, the processor 252 has, in effect, calculated the appropriate start address and therefore, functions 940 and 950 are performed much in the same manner as functions 680 and 690 to output the desired character string. In this case the processing skips via Z to function 960 (see FIG. 16A).

In connection with FIGS. 1 and 2 it has been indicated that an automatic word ending mode latch AWE which is set and reset or alternate actuations of the key 38 can be used to assist in determining whether automatic word ending is appropriate when a multi-purpose key is used to initiate automatic word ending.

Figure 17A:
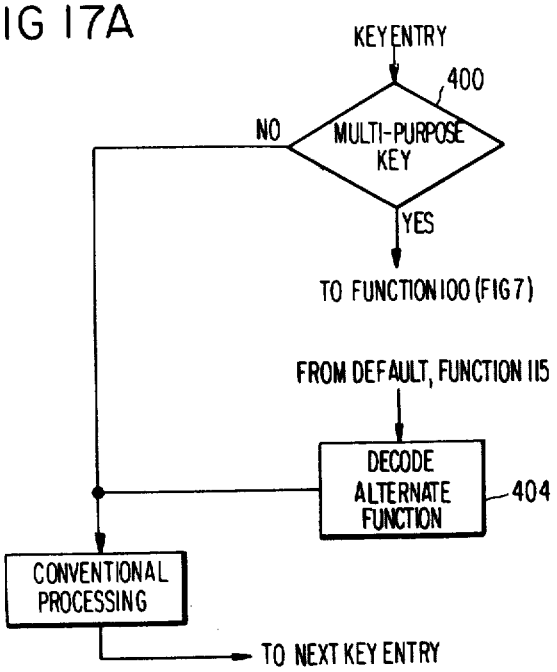
FIGS. 17A and 17B illustrate supplementary logic in connection with use of a multi-purpose key without use of a mode latch.
Figure 17B:
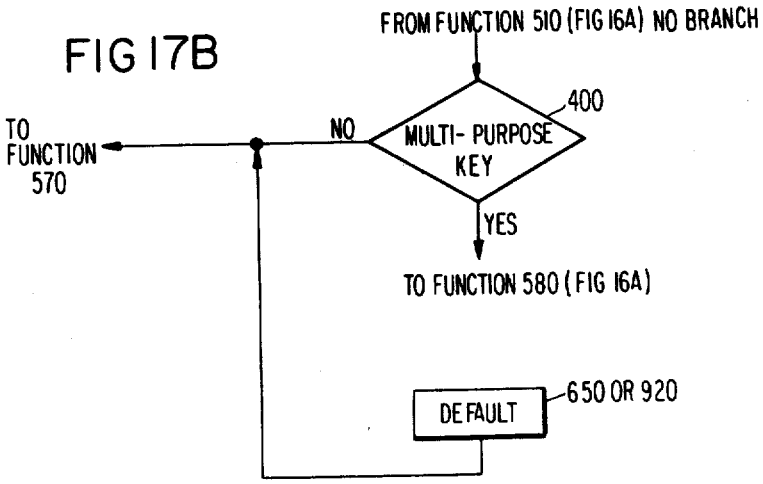

Furthermore, we have indicated that the automatic word ending mode latch AWE can be eliminated and automatic word ending operation initiated solely in dependence on previously actuated characters. FIG. 17A illustrates the processing in connection with FIG. 7. As is apparent, every actuation of a multi-purpose key (detected at function 400) is treated as an automatic word ending command and the key's alternate function (typically a numeric character, punctuation graphic or function) is decoded and performed (function 404) only for the case of a default in automatic word ending. FIG. 17B illustrates the processing in connection with the logic of FIG. 16A-C wherein functions 404, 650 and 920 have the same effect as the same functions in FIGS. 17A, 16A and 16C, respectively. To effect a similar result with the logic of FIG. 10 requires some modification to the logic of FIG. 10 to ensure that the alpha sequence ID is an expected quantity (one that corresponds to a word ending) before attempting to output a character string.

From the foregoing it should be apparent how automatic word ending operation is initiated with or without a mode latch and with single purpose or multi-purpose keys and how, when automatic word ending is initiated, an appropriate word ending is selected from an ensemble of word endings in dependence on the previously actuated keys.

APPENDIX

A

| SION | ALPHA SEQUENCE ID | TION | ALPHA SEQUENCE ID |
|---|---|---|---|
| abrasion | 72 | installation | 134 |
| occasion | 55 | illumination | 112 |
| persuasion | 101 | illustration | 137 |
| invasion | 57 | imagination | 96 |
| TION | | | |
| application | 112 | implication | 92 |
| association | 121 | importation | 117 |
| administration | 154 | incorporation | 134 |
| appreciation | 119 | iteration | 74 |
| authorization | 148 | investigation | 119 |
| affiliation | 94 | interrogation | 120 |
| accomodation | 113 | jubilation | 84 |
| allocation | 98 | justification | 131 |
| appropriation | 160 | legation | 42 |
| characterization | 171 | liberation | 68 |
| configuration | 115 | limitation | 89 |
| consideration | 109 | litigation | 96 |
| cooperation | 98 | lubrication | 95 |
| corporation | 115 | lamination | 96 |
| conversation | 118 | legislation | 82 |
| congratulation | 146 | location | 60 |
| communication | 121 | modification | 89 |
| conservation | 118 | manifestation | 130 |
| compensation | 107 | migration | 69 |
| calculation | 111 | mobilization | 91 |
| combination | 82 | modernization | 101 |
| confirmation | 104 | multiplication | 145 |
| certification | 103 | negotiation | 84 |
| clarification | 120 | nomination | 83 |
| continuation | 118 | narration | 98 |
| computation | 101 | notation | 71 |
| cancellation | 101 | oxidation | 78 |
| denunciation | 88 | operation | 76 |
| deportation | 100 | organization | 112 |
| designation | 72 | obligation | 67 |
| demonstration | 126 | occupation | 92 |
| declaration | 94 | orientation | 99 |
| determination | 102 | observation | 103 |
| depreciation | 82 | population | 106 |
| deterioration | 112 | presentation | 111 |
| dictation | 66 | penetration | 92 |
| diversification | 130 | participation | 147 |
| discrimination | 124 | publication | 93 |
| examination | 109 | penalization | 105 |
| explanation | 115 | punctuation | 121 |
| exploitation | 123 | quotation | 99 |
| exploration | 112 | qualification | 133 |

APPENDIX-continued

| | | | |
|---|---|---|---|
| exportation | 120 | radiation | 83 |
| exultation | 104 | recreation | 71 |
| expropriation | 43 | regulation | 81 |
| evaluation | 108 | recommendation | 108 |
| education | 59 | relation | 57 |
| equalization | 117 | rehabilitation | 131 |
| elimination | 80 | reservation | 105 |
| equation | 64 | registration | 114 |
| formation | 78 | ration | 44 |
| fabrication | 94 | radiation | 83 |
| fixation | 65 | ramification | 114 |
| fertilization | 106 | specification | 100 |
| fermentation | 95 | standardization | 167 |
| flirtation | 91 | situation | 95 |
| fraternization | 139 | simulation | 100 |
| foundation | 82 | salutation | 124 |
| generation | 59 | simplification | 126 |
| graduation | 98 | stimulation | 120 |
| gyration | 72 | stipulation | 123 |
| generalization | 111 | segmentation | 93 |
| hospitalization | 165 | toxication | 101 |
| humiliation | 98 | triplication | 117 |
| inspiration | 107 | termination | 97 |
| identification | 101 | taxation | 96 |
| interpretation | 139 | translation | 131 |
| inflation | 63 | utilization | 102 |
| investigation | 119 | vocation | 70 |
| indication | 65 | vacation | 81 |
| implementation | 121 | variation | 101 |
| information | 121 | verification | 98 |
| invitation | 97 | valuation | 107 |

B

NONE

C

| CEED | ALPHA SEQUENCE ID | TION | ALPHA SEQUENCE ID |
|---|---|---|---|
| suceed | 47 | deduction | 37 |
| CEDE | | diction | 20 |
| accede | 33 | direction | 39 |
| IZE | | destruction | 90 |
| anglicize | 67 | election | 21 |
| criticize | 70 | function | 44 |
| italicize | 83 | indiction | 51 |
| ostracize | 105 | introduction | 104 |
| ISE | | instruction | 104 |
| circumcise | 82 | inspection | 62 |
| excise | 32 | obstruction | 102 |
| exercise | 51 | objection | 39 |
| exorcise | 65 | production | 81 |
| encise | 26 | protection | 77 |
| TION | | perfection | 49 |
| action | 33 | resurrection | 103 |
| collection | 54 | restriction | 92 |
| construction | 117 | subjection | 64 |
| connection | 50 | selection | 40 |
| conjunction | 84 | transaction | 126 |

D

| ISE | ALPHA SEQUENCE ID | IZE | ALPHA SEQUENCE ID |
|---|---|---|---|
| merchandise | 87 | jeopardize | 94 |
| paradise | 90 | standardize | 127 |
| | | subsidize | 74 |

E

| TION | ALPHA SEQUENCE ID | CEDE | ALPHA SEQUENCE ID |
|---|---|---|---|
| completion | 64 | antecede | 57 |
| SION | | precede | 35 |
| adhesion | 39 | recede | 19 |
| | | secede | 20 |

F

NONE

G

| IZE | ALPHA SEQUENCE ID |
|---|---|
| apologize | 87 |
| eulogize | 52 |
| energize | 33 |

H

| IZE | ALPHA SEQUENCE ID | ISE | ALPHA SEQUENCE ID |
|---|---|---|---|
| philosophize | 110 | affranchise | 107 |
| symphathize | 127 | disenfranchise | 118 |
| | | disfranchise | 107 |
| | | enfranchise | 86 |
| | | franchise | 75 |

I

| SION | ALPHA SEQUENCE ID | TION | ALPHA SEQUENCE ID |
|---|---|---|---|
| collision | 55 | condition | 45 |
| division | 44 | competition | 81 |
| decision | 21 | definition | 39 |
| derision | 32 | deposition | 64 |
| indecision | 40 | disposition | 91 |
| precision | 51 | exposition | 84 |
| revision | 50 | nutrition | 78 |
| subdivision | 86 | position | 59 |
| supervision | 106 | premonition | 82 |
| television | 65 | recognition | 63 |
| vision | 31 | recondition | 64 |
| TION | | tradition | 77 |
| addition | 43 | transition | 102 |
| acquisition | 108 | | |

J

NONE

K

NONE

L

| YZE | ALPHA SEQUENCE ID | IZE | ALPHA SEQUENCE ID |
|---|---|---|---|
| analyze | 74 | legalize | 54 |
| paralyze | 98 | liberalize | 80 |
| IZE | | naturalize | 133 |
| alkalize | 87 | neutralize | 108 |
| brutalize | 99 | normalize | 94 |
| crystallize | 139 | materialize | 125 |
| civilize | 59 | memorialize | 107 |
| commercialize | 121 | moralize | 84 |
| capitalize | 116 | professionalize | 166 |
| centralize | 94 | penalize | 65 |
| devitalize | 94 | personalize | 117 |
| demobilize | 56 | realize | 57 |
| demoralize | 89 | rationalize | 136 |
| equalize | 77 | specialize | 90 |
| evangelize | 75 | scandalize | 104 |
| federalize | 68 | sterilize | 79 |
| focalize | 66 | tantalize | 114 |
| fertilize | 66 | tranquilize | 133 |
| generalize | 71 | utilize | 62 |
| idealize | 52 | visualize | 109 |
| immobilize | 73 | verbalize | 81 |
| immortalize | 126 | vitalize | 82 |
| idolize | 40 | symbolize | 86 |
| journalize | 116 | | |

M

| ISE | ALPHA SEQUENCE ID | IZE | ALPHA SEQUENCE ID |
|---|---|---|---|
| comprise | 97 | anatomize | 110 |
| demise | 18 | atomize | 74 |
| premise | 48 | epitomize | 74 |
| surmise | 71 | economize | 61 |
| | | victimize | 80 |

APPENDIX-continued

N

| CEDE | ALPHA SEQUENCE ID | IZE | ALPHA SEQUENCE ID |
|---|---|---|---|
| concede | 32 | galvanize | 99 |
| TION | | humanize | 78 |
| attention | 77 | lionize | 46 |
| convention | 65 | mechanize | 65 |
| intervention | 91 | modernize | 61 |
| invention | 52 | organize | 72 |
| intention | 50 | patronize | 105 |
| mention | 24 | revolutionize | 143 |
| IZE | | recognize | 54 |
| agonize | 54 | reorganize | 91 |
| colonize | 59 | solemnize | 70 |
| disorganize | 104 | synchronize | 112 |
| fraternize | 99 | vulcanize | 98 |

O

| CEED | ALPHA SEQUENCE ID | TION | ALPHA SEQUENCE ID |
|---|---|---|---|
| proceed | 49 | motion | 28 |
| SION | | promotion | 77 |
| explosion | 68 | | |

P

| ISE | ALPHA SEQUENCE ID | TION | ALPHA SEQUENCE ID |
|---|---|---|---|
| Despise | 40 | consumption | 101 |
| | | description | 74 |
| | | inception | 43 |
| | | adoption | 61 |
| | | exception | 49 |

Q

NONE

R

| SEDE | ALPHA SEQUENCE ID | TION | ALPHA SEQUENCE ID |
|---|---|---|---|
| supersede | 75 | insertion | 57 |
| CEDE | | portion | 49 |
| intercede | 58 | IZE | |
| SION | | mesmerize | 65 |
| conversion | 73 | notarize | 78 |
| excursion | 71 | pasteurize | 121 |
| subversion | 83 | particularize | 173 |
| version | 41 | plagarize | 110 |
| IZE | | popularize | 124 |
| authorize | 108 | pulverize | 90 |
| burglarize | 100 | prize | 34 |
| cauterize | 93 | secularize | 105 |
| characterize | 131 | summarize | 110 |
| circularize | 118 | terrorize | 90 |
| extermprize | 108 | theorize | 62 |
| familiarize | 119 | vaporize | 97 |
| | | vulgarize | 102 |

S

| TION | ALPHA SEQUENCE ID | SION | ALPHA SEQUENCE ID |
|---|---|---|---|
| question | 58 | impression | 74 |
| suggestion | 66 | mission | 41 |
| IZE | | obsession | 56 |
| emphasize | 83 | possession | 89 |
| hypothesize | 112 | profession | 75 |
| size | 19 | permission | 76 |
| SION | | preadmission | 106 |
| admission | 71 | recompression | 108 |
| commission | 76 | remission | 60 |
| confession | 58 | session | 39 |
| compression | 89 | submission | 83 |
| discussion | 79 | succession | 74 |
| depression | 59 | transmission | 134 |
| expression | 79 | transgression | 134 |
| fission | 34 | | |

T

| ISE | ALPHA SEQUENCE ID | IZE | ALPHA SEQUENCE ID |
|---|---|---|---|
| advertise | 91 | demagnetize | 78 |
| chastise | 80 | dramatize | 107 |
| mortise | 66 | deputize | 62 |
| IZE | | hypnotize | 94 |
| alphabetize | 111 | magnetize | 63 |
| appetize | 79 | sensitize | 78 |
| baptize | 64 | stigmatize | 110 |
| dehypnotize | 99 | systematize | 143 |

U

| ISE | ALPHA SEQUENCE ID | TION | ALPHA SEQUENCE ID |
|---|---|---|---|
| disguise | 56 | precaution | 76 |
| SION | | resolution | 94 |
| confession | 59 | revolution | 89 |
| TION | | SION | |
| contribution | 102 | collusion | 67 |
| constitution | 121 | conclusion | 72 |
| distribution | 102 | extrusion | 84 |
| execution | 54 | inclusion | 59 |
| institution | 108 | intrusion | 78 |
| pollution | 76 | transfusion | 120 |

V

| ISE | ALPHA SEQUENCE ID |
|---|---|
| advise | 52 |
| devise | 27 |
| improvise | 93 |
| misadvise | 93 |
| revise | 41 |
| supervise | 97 |
| televise | 56 |

W

| ISE | ALPHA SEQUENCE ID |
|---|---|
| clockwise | 75 |
| counterclockwise | 167 |
| likewise | 56 |
| otherwise | 85 |
| sidewise | 56 |
| unwise | 54 |
| wise | 53 |

X

| CEED | ALPHA SEQUENCE ID |
|---|---|
| exceed | 25 |

Y

NONE

Z

NONE

What is claimed is:

1. An automatic word ending text recorder of the kind having:

text display means to display a sequence of text characters in intelligible form in response to character and function identifying signals, keyboard means including a plurality of alphanumeric, symbol and function keys to produce a key-code signal unique to any operator-actuated key, and decoding means responsive to keycode signals from said keyboard means to produce said character and function identifying signals, wherein the improvement comprises:

word ending means within said decoding means producing one of at least two groups of one or more character identifying signals in response to actuation of a selected key on said keyboard, each group of character identifying signals representing a different word ending and wherein said word ending means includes means for selecting among said groups depending upon identification of one or more key actuations prior to actuation of said selected key.

2. The apparatus of claim 1 wherein said decoding means includes means to store representations of a plurality of actuated keys in an ordered sequence in which said keys were actuated by an operator, addressing means rendered operative by actuation of said selected key to address said means to store in reverse order sequence to thereby read from said means to store one or more keycode signals in said reverse ordered sequence, and decision means responsive to said readout keycode signals to select an appropriate word ending and to produce a representation thereof.

3. The apparatus of claim 2 wherein said representation produced by said decision means comprises an address at which is stored a representation of a character sequence corresponding to said selected appropriate word ending.

4. The apparatus of claim 3 in which said representation of said character sequence comprises a sequence of pointers, each of which points to a stored representation of a different character identifying signal, and a function control storage means pointed to by said sequence of pointers storing a character identifying signal for each of said characters in said sequence.

5. The apparatus of claim 2 in which said decision means comprises:

continue address register means, means responsive to each keycode signal, when produced by said means to store, to sum a keycode representing quantity and the contents of said continue address register means, and table means addressed by said continue address register means subsequent to operation of said means to sum to produce said representation of said appropriate word ending.

6. The apparatus of claim 5 in which said table means include, a sub-table for each node in a decision tree identifying each appropriate word ending by reference to preceding characters in inverse order of appearance in a word, wherein each entry in said sub-table identifies, (a) an appropriate word ending, or (b) a different sub-table corresponding to a connected node in said decision tree or (c) a default condition, and wherein said continue address register means, after operation of said means to sum, addresses a specific entry in a sub-table.

7. The apparatus of claim 6 in which each entry in each sub-table includes at least a multi-bit control entry identifying the associated entry as, (a) an appropriate word ending, or (b) a different sub-table corresponding to a connected node in said decision tree, or (c) a default condition.

8. The apparatus of claim 7 in which the decision means includes means responsive to a control entry identifying a different sub-table to replace the contents of said continue address register means with at least a portion of said entry.

9. The apparatus of claim 1 wherein: said word ending means includes sequence accumulator means for forming and retaining a sum of quantities, each of said quantities unique to a character key, and means for clearing said sequence accumulator means on actuation of a numerical, function or symbol graphic key, character sequence table means with an entry for each appropriate word ending representing each character in said word ending, and means responsive to actuation of said selected key to address said character sequence table means with the contents of said sequence accumulator means.

10. The apparatus of claim 9 which further includes:

a hyphen flag register, means to set said hyphen flag register on detection of actuation of a hyphen key, means to reset said hyphen flag register on detection of actuation of an alpha key, and means responsive to actuation of a function key to inhibit clearing of said sequence accumulator means, if said hyphen flag register is set.

11. The apparatus of claim 1 wherein said word ending means includes:

means to store a representation of each actuated key in an ordered sequence, addressing means responsive to actuation of said selected key to read at least a representation of a preceding key actuation from said means to store, and table means addressed by said representation read from said means to store in response to actuation of said selected key to produce a corresponding data unit, some of said data units comprising a representation of said selected word ending.

12. The apparatus of claim 11 wherein said word ending means further includes:

alpha sequence accumulator means for forming and retaining a sum of quantities, each of said quantities unique to a character key, in response to actuation of keys of said keyboard means, means for clearing said alpha sequence accumulator means on actuation of any key within a selected sub-set of non-alpha keys, and means for combining said data units with contents of said alpha sequence accumulator means on actuation of said selected key to produce modified data units, first comparing means for comparing a data unit from said table means with a first reference to detect a default condition, and second comparing means for comparing a modified data unit with a second reference and to identify a selected word ending from said modified data unit if said comparison with said second reference is favorable.

13. The apparatus of claim 12 wherein said word ending means further includes:

alpha table means addressed by a modified data unit for storing and reading out, when addressed, a second data unit, third comparing means for comparing contents of said alpha sequence accumulator means with said second data unit, means for incrementing said alpha table means to obtain a third data unit, test means to test for one or another test on said third data unit depending on the outcome of said third comparison, means for extracting a representation of said selected word ending from said third data unit if said third comparison is favorable and said one test is passed, and a first entry register, and means to store in said first entry register a representation of a first character of a word and means to clear said first entry register on actuation of a selected sub-set of keys of said keyboard means.

14. The apparatus of claim 13 which further includes exception table means, means to address said exception table means with said third data unit, if said third comparison is favorable and said one test is not passed, fourth comparison means for comparing a fourth data unit from said exception table means with contents of said first entry register, and means, responsive to a favorable result of said fourth comparison for extracting, from said exception table means, a representation of said selected word ending.

15. The apparatus of claim 13 which further includes means for further incrementing said alpha table means, if said third comparison is unfavorable and said another test is passed, and extracting a representation of said selected word ending.

16. The apparatus of claim 13 which further includes means for further incrementing said alpha table means, if said third comparison is unfavorable and said another test is not passed and for extracting another data unit for said third comparison means.

17. The apparatus of claim 12 wherein said word ending means further includes:

alpha table means addressed by a modified data unit for storing and reading out, when addressed a second data unit, third comparing means for comparing contents of said alpha sequence accumulator means with said second data unit, means for extracting a representation of said selected word ending from a third data unit read from said alpha table means if said third comparison is favorable, and means for incrementing through said alpha table means if said third comparison is unfavorable.

18. The apparatus of claim 17 wherein said alpha table means includes at least two entries, a first entry including said second data unit and said third data unit and at least one entry including said third data unit but omitting said second data unit.

19. The apparatus of claim 18 in which said alpha table means includes, in an entry preceding said at least one entry, a last compare flag set to a distinctive condition and which further includes, means responsive to said set last compare flag to extract said third data unit of said at least one entry as a representation of said character identifying signals.

20. The apparatus of claim 1 wherein said word ending means includes first means responsive to actuation of a function key, subsequent to actuation of said selected key, to clear a register, a hyphen flag register, means to set said hyphen flag register on detection of actuation of a hyphen key, means to reset said hyphen flag register on detection of an alpha key, means responsive to detection of a function key actuation to inhibit operation of said first means.

21. The apparatus of claim 1 in which said word ending means operates on each actuation of said selected key.

22. The apparatus of claim 1 which further includes, mode changing key means for changing an operating mode of said text recorder from an automatic word ending mode to a non-automatic word ending mode and in which said selected key selectively actuates said word ending means only when said text recorder is in an automatic word ending mode.

23. The apparatus of claim 1 which further includes, means responsive to actuation of said selected key for selectively producing a group of character identifying signals or producing a different character/function identifying signal and further including default means in said word ending means for signaling a default condition if an appropriate word ending cannot be selected and means responsive to said default means for initiating said different character/function identifying signal.

24. A method of operating a text recorder such as an electronic typewriter to provide appropriate word endings, on command, which text recorder includes keyboard means with plural alpha, numeric, function and symbol graphic keys, and at least one key for initiating an automatic word ending operation, text display means for displaying a sequence of text characters in intelligible form, and decoding means responsive to operation of said keyboard means for driving said text display means in which the method comprises the steps of:

storing a CPT table representing a matrix of appropriate word endings as a function of the character preceding a word ending, if said preceding character uniquely identifies an appropriate word ending, actuating an automatic word ending initiating key, and addressing said CPT table with a representation of a character preceding actuation of an automatic word ending initiation key to identify an appropriate word ending, and employing said identification to output a word ending character string to said text display means.

25. The method of claim 24 in which said text recorder includes an alpha sequence register which sums a unique quantity for each alpha key actuation with the contents of said alpha sequence register and which includes means to clear said alpha sequence register on actuation of selected non-alpha keys, and wherein said method includes the further steps of:

storing a separate alpha table for each character preceding a word ending, which character does not uniquely identify a word ending, each alpha table comprising an entry for each word ending preceded by the character associated with the word ending, said entry including either a pointer to an appropriate word ending and an ID sequence number, if said ID sequence number uniquely identifies said word ending, or a pointer to an exception table pointer, a flag and an ID sequence number if said ID sequence number does not uniquely identify an appropriate word ending, storing in said CPT table a pointer to an associated alpha table, incrementing through said associated alpha table until the contents of said alpha sequence register matches the ID sequence number, and extracting said word ending pointer if no flag is found or extracting said exception table pointer if said flag is found.

26. The method of claim 25 in which said associated alpha table includes a last entry flag, said incrementing step is performed only once after said last entry flag is found and said extracting step is performed with said incremented address.

27. The method of claim 25 in which said text recorder includes, an entry register which stores a quantity representative of a selected character in a word and is cleared on actuation of selected non-alpha keys, and in which the method includes the further steps of:

storing an exception table comprising an entry for each conflict where an alpha sequence register content corresponds to more than a single word ending, each said ending related to said entry, and exception data uniquely related to a character in one word associated with one but not the other word ending, comparing exception data in an exception table entry with the contents of said entry register and selecting one or the other of said different pointers depending on said comparison.

28. The method of claim 27 wherein said entry register stores a data unit corresponding to the first letter of a word and said exception data represents an alpha character.

* * * * *